US008800195B2

(12) United States Patent
LaFrance et al.

(10) Patent No.: US 8,800,195 B2
(45) Date of Patent: Aug. 12, 2014

(54) MACHINE GUN ACCESSORY MOUNT

(75) Inventors: Timothy F. LaFrance, Newport Beach, CA (US); Michael D. Picciotta, Yorba Linda, CA (US)

(73) Assignee: SureFire, LLC, Fountain Valley, CA (US)

( * ) Notice: Subject to any disclaimer, the term of this patent is extended or adjusted under 35 U.S.C. 154(b) by 21 days.

(21) Appl. No.: 13/417,820

(22) Filed: Mar. 12, 2012

(65) Prior Publication Data

US 2012/0159831 A1 Jun. 28, 2012

Related U.S. Application Data

(63) Continuation-in-part of application No. 12/343,971, filed on Dec. 24, 2008, now Pat. No. 8,141,290.

(60) Provisional application No. 61/501,038, filed on Jun. 24, 2011.

(51) Int. Cl.
*F41G 1/387* (2006.01)
*F41G 1/32* (2006.01)

(52) U.S. Cl.
CPC . *F41G 1/387* (2013.01); *F41G 1/32* (2013.01)
USPC ..... 42/146; 42/114

(58) Field of Classification Search
CPC ..... F41G 1/38; F41G 1/387; F41G 1/393; F41G 1/32; F41G 1/34; F41G 1/345; F41G 1/35; F41G 1/36
USPC ..... 42/114, 115, 117, 146
See application file for complete search history.

(56) References Cited

U.S. PATENT DOCUMENTS

| | | | | |
|---|---|---|---|---|
| 2,363,563 | A | 11/1944 | Vinson | |
| 2,870,679 | A | 1/1959 | Collins | |
| 2,900,875 | A | 8/1959 | Fergus et al. | |
| 3,368,454 | A | 2/1968 | Peck et al. | |
| 4,716,809 | A | 1/1988 | A'Costa | |
| 5,704,155 | A | 1/1998 | Primeau, IV | |
| 5,784,822 | A | 7/1998 | Korapaty | |
| 6,276,088 | B1 | 8/2001 | Matthews et al. | |
| 6,318,230 | B1 | 11/2001 | Bamber | |
| 6,378,237 | B1 | 4/2002 | Matthews et al. | |
| 6,393,752 | B1 * | 5/2002 | Oliver et al. | 42/114 |
| 6,508,027 | B1 | 1/2003 | Kim | |
| 6,622,416 | B2 | 9/2003 | Kim | |

(Continued)

FOREIGN PATENT DOCUMENTS

FR 2691793 12/1993

OTHER PUBLICATIONS

Dillon Aero Inc., Operation and Maintenance Manual, M134D (all models), M134E and MK49 Gatling Guns, Cover page and pp. A-55 to A-56, Oct. 2008, 3 pages.

*Primary Examiner* — Stephen M Johnson
(74) *Attorney, Agent, or Firm* — Haynes and Boone, LLP

(57) ABSTRACT

In one example, an accessory mount for a gun, such as a machine gun, can include a base configured for attachment of the accessory mount to the gun, a holding mechanism for fixing the position of the base in relation to the gun, and an elongated accessory mounting arm coupled to the base and extending forwardly therefrom, the arm comprising a beam having a vertical web with at least one flange disposed at an upper and/or a lower end thereof.

16 Claims, 25 Drawing Sheets

(56) References Cited

U.S. PATENT DOCUMENTS

| | | | | |
|---|---|---|---|---|
| 6,655,069 | B2 | 12/2003 | Kim | |
| 6,779,288 | B1 | 8/2004 | Kim | |
| 6,854,206 | B2 | 2/2005 | Oz | |
| 6,895,708 | B2 | 5/2005 | Kim et al. | |
| 7,117,624 | B2 | 10/2006 | Kim | |
| 7,258,055 | B1 | 8/2007 | Javorsky | |
| 7,559,167 | B1 | 7/2009 | Moody et al. | |
| 7,770,505 | B2 | 8/2010 | McClellan et al. | |
| 2003/0230022 | A1 | 12/2003 | Battaglia | |
| 2004/0103577 | A1 | 6/2004 | Compton | |
| 2006/0288626 | A1 | 12/2006 | Kim | |
| 2008/0155876 | A1 | 7/2008 | Matthews et al. | |
| 2010/0154280 | A1 | 6/2010 | LaFrance et al. | |
| 2011/0061281 | A1* | 3/2011 | Kapusta et al. | 42/71.01 |
| 2011/0100203 | A1 | 5/2011 | Genes et al. | |
| 2013/0205634 | A1* | 8/2013 | Langevin et al. | 42/71.01 |

* cited by examiner

MACHINE GUN ACCESSORY MOUNT

CROSS-REFERENCE TO RELATED APPLICATIONS

This application claims the benefit of U.S. Provisional Patent Application No. 61/501,038 entitled "MACHINE GUN ACCESSORY MOUNT" filed Jun. 24, 2011, which is hereby incorporated by reference in its entirety.

This application is a continuation-in-part application of U.S. patent application Ser. No. 12/343,971 entitled "MACHINE GUN ACCESSORY MOUNT" filed Dec. 24, 2008, now U.S. Pat. No. 8,141,290, which is hereby incorporated by reference in its entirety.

BACKGROUND

1. Technical Field

This disclosure relates to military weaponry in general, and in particular, to accessory mounting devices for machine guns.

2. Related Art

One of the more effective infantry combat weapons deployed by the United States and allied forces during both this and the last century has been the Browning .50 caliber M2HB heavy machine gun. It has been shown to be effective against infantry, lightly armored land vehicles and boats, light fortifications, and low-flying aircraft, and has been used extensively both as a vehicle-mounted weapon and for aircraft armament by the United States from 1927 to the present. It was used extensively during World War II, the Korean War, the Vietnam War and the war in Iraq. It is the primary heavy machine gun of NATO countries and has also been used by many other countries. It is still in use today, with some modern innovations and improvements, and has been in use longer than any other small arm currently in the U.S. inventory.

One of the improvements to the gun that users have found particularly advantageous has been the ability to use a variety of accessories with it, such as advanced gun sighting devices and lighting devices for better illuminating the gun's field of fire in dim or dark lighting conditions. The former includes, for example, telescopic, laser, infrared (IR) and so-called "starlight" night vision device (NVD) gun sights, and the latter includes, for example, powerful IR and/or white light spotlights that are able to reveal enemy activity and illuminate targets at great distances in twilight or night conditions, such as the SureFire HellFighter® gun spotlight, model nos. HF1A, HF1B, and HF1C, manufactured by SureFire, LLC, Fountain Valley, Calif.

As those of some skill in this art will appreciate, in order to integrate such accessories with a machine gun (e.g., a heavy machine gun or otherwise) successfully, it is necessary to provide mechanisms for mounting the accessories on the gun that are able to withstand the rigors of adverse battlefield environmental conditions as well as the extremes of shock and vibration of the gun when fired. Over the years, a number of gun accessory mounts have been developed, examples of which can be found in the patent literature, including, e.g., in U.S. Pat. No. 5,704,155 to D. Primeau, IV; U.S. Pat. Nos. 6,508,027, 6,655,069, and 6,779,288 to P. Kim; and, U.S. Pat. No. 6,895,708 to P. Kim et al.

While these previous gun accessory mounts address some of the above accessory-to-gun integration issues to some extent, they are not without certain drawbacks when applied to machine guns such as the M2HB, including that some cannot be used with guns having ballistic shields, some have clamping lugs that do not accommodate the various gun shroud hole patterns found in different models of machine guns without some modification of the shroud and/or the lugs, some cannot be used with guns that incorporate a quick change barrel (QCB), and some locate a spotlight accessory at a position relative to the barrel of the gun such that extensive firing of the gun can result in the gunner's view of the field of fire being obscured by a "whiteout" effect.

Accordingly, what is needed is a more "universal" machine gun accessory mount that is light in weight, yet sufficiently robust to withstand adverse environmental conditions and the shock and vibrations of the gun during firing, and which is also capable of reliably mounting a variety of accessories on virtually any model of machine gun in use today, regardless of the gun's shroud hole pattern or diameter and whether or not it incorporates a ballistic shield or a QCB.

BRIEF SUMMARY

In accordance with the present disclosure, universal, light weight, yet robust machine gun accessory mounts are provided that are capable of withstanding harsh environmental conditions and the shock and vibration of the gun firing, and which are also capable of reliably mounting a variety of target sighting and illuminating accessories on virtually any model of machine gun, regardless of its particular configuration.

In one example embodiment, an accessory mount for a gun, such as a machine gun, includes a base configured for attachment of the accessory mount to the gun, a holding mechanism for fixing the position of the base in relation to the gun, and an elongated accessory mounting arm coupled to the base and extending forwardly therefrom, the arm comprising a beam having a vertical web with at least one flange disposed at an upper and/or a lower end thereof.

In some embodiments, the holding mechanism can comprise a plurality of threaded bolts that extend rearwardly from the base through respective bolt apertures contained therein and a plurality of mounting cleats, each having an opening into which a rear end portion of a respective one of the bolts is received, and a hook adapted to grip an edge of a corresponding hole in the shroud of the gun. In one embodiment, the opening in at least one of the cleats can be threaded, and a corresponding one of the threaded bolts is disposed in threaded engagement with the opening of the cleat. In another embodiment, the opening in at least one of the cleats can comprise an unthreaded through-hole, and the corresponding bolt can be disposed in threaded engagement with a threaded nut disposed behind the cleat.

In some embodiments, the cleats can be arranged such that advancement of the bolts into respective ones of the cleats causes the hook of each cleat to grip an edge of the corresponding hole in the shroud, and the planar floor of the counterbore in the rear surface of the base to be pulled into contact with and held firmly against the planar front surface of the shroud. One or more accessory mounting rails can be mounted on a surface of a forward end portion of the accessory mounting arm and used to mount a variety of gun accessories, such as gun sights and lighting sources, such as a flashlight or a spot light, to a variety of different gun configurations.

In some embodiments, the base can comprise an annular structure having a circular central opening configured to be disposed concentrically over a barrel of the gun and a concentric counterbore extending into a rear surface thereof, and the counterbore can define a planar floor that is configured to be disposed concentrically over a front end of a shroud of the gun, with the floor of the counterbore disposed against a substantially planar front surface of the shroud.

In some embodiments, the gun can include a yoke defining a first mounting and alignment feature, the base can comprise a bracket having a second mounting and alignment feature that is complementary in shape to the first mounting and alignment feature, and the holding mechanism can comprise at least one threaded fastener extendable through an aperture in the bracket and into a corresponding threaded aperture in the yoke while the first and second mounting and alignment features are engaged with each other.

In some embodiments, the gun can include a gun mount having a front surface, a portion of which is substantially flat and which includes at least one threaded mounting aperture disposed therein, the base can comprise an L-shaped bracket having an upstanding leg with a substantially flat rear surface and at least one through-hole corresponding to the at least one threaded mounting aperture in the gun mount, and the holding mechanism can comprise at least one threaded fastener extendable through the at least one corresponding aperture in the bracket and into the at least one threaded mounting aperture in the gun mount.

In some embodiments, the accessory mounting arm can advantageously comprise an extrusion.

The scope of the invention is defined by the claims, which are incorporated into this section by reference. A better understanding of the above and many other features and advantages of the novel heavy machine gun accessory mounts of the present disclosure can be obtained from a consideration of the detailed description of some example embodiments thereof below, particularly if such consideration is made in conjunction with the appended drawings, wherein like reference numerals are used to identify like elements illustrated in one or more of the figures thereof.

DETAILED DESCRIPTION

Figure 1:
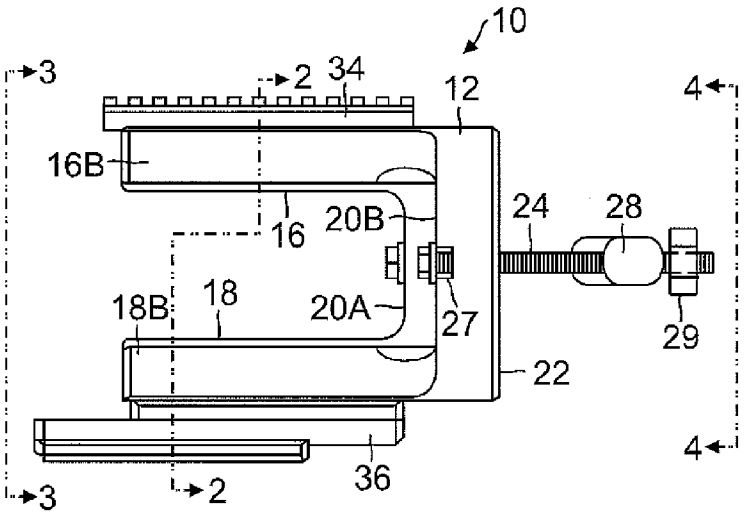
FIG. 1 is left side elevation view of an example embodiment of a short-tined heavy machine gun accessory mount.

FIG. 1 is left side elevation view of an example embodiment of a heavy machine gun accessory mount 10. With reference to FIGS. 1-4, the example accessory mount 10 comprises an annular base 12 containing a cylindrical opening or lumen 14 that is adapted to be disposed concentrically about the barrel 110 and barrel shroud 106 of a heavy machine gun 100 (see FIG. 17) on which the accessory mount 10 is to be mounted, and to permit reciprocating axial recoil of the barrel to occur relative to the base during firing of the recoil-operated weapon.

Figure 17:
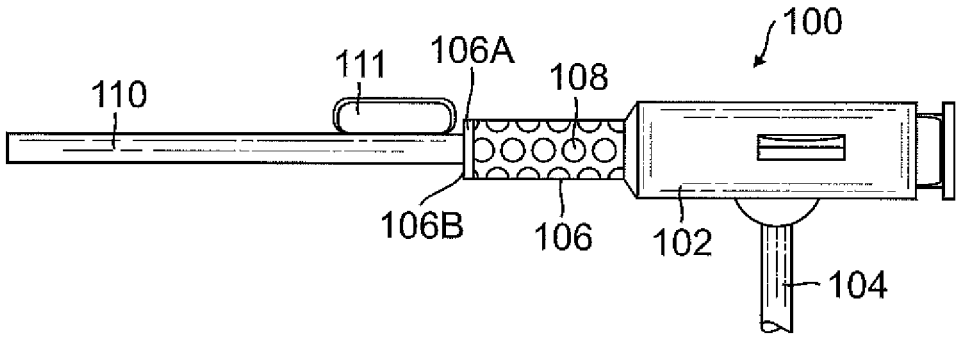
FIG. 17 is a partial left side elevation view of a .50 caliber heavy machine gun of a type to which the accessory mounts of the present disclosure have advantageous application.

With reference to FIG. 17, the host machine gun 100 includes a receiver 102 that is typically mounted on a stand 104 of a type that enables a barrel 110 of the gun to be traversed left and right and elevated up and down. The gun 100 further includes a shroud 106 that includes a bushing 106A having a substantially planar front surface 106B, and incorporates a plurality of generally circular holes 108 disposed in a regular pattern. The elongated, rifled barrel 110 of the gun is supported by the shroud 106 and the receiver 102 to move axially in a reciprocating manner relative to the shroud and receiver, and hence, the accessory mount 10 mounted thereto, during firing of the gun 100.

Figure 2:
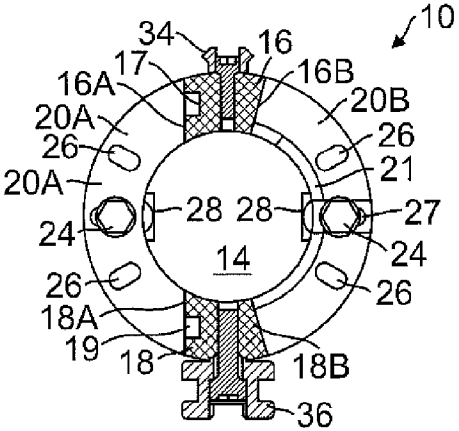
FIG. 2 is a cross-sectional view of the accessory mount of FIG. 1, as seen along the lines of the section 2-2 taken therein.
Figure 3:
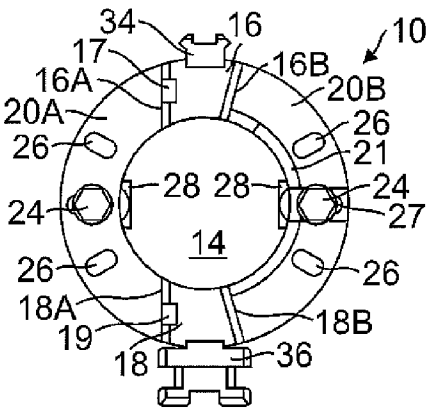
FIG. 3 is a front end elevation view of the accessory mount of FIG. 1, as seen along the lines of the section 3-3 taken therein.
Figure 4:
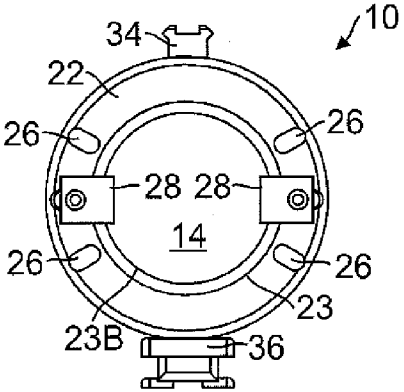
FIG. 4 is a rear end elevation view of the accessory mount of FIG. 1, as seen along the lines of the section 4-4 taken therein.
Figure 5:
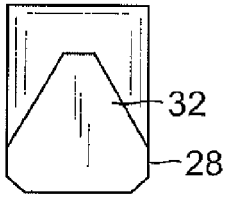
FIG. 5 is a front elevation view of an example embodiment of a mounting cleat of the accessory mount of FIG. 1.

With reference to FIGS. 1-4, a pair of diametrically opposing upper and lower accessory mounting arms or tines 16 and 18 extend forwardly from the base 12. As illustrated in FIG. 4, the base 12 can include a rear surface 22 having an axial counterbore 23 extending into it. The counterbore can define a substantially planar ledge or floor 23B. When the counterbore 23 of the base 12 is disposed concentrically over the front end of the bushing 106A at the front end of the barrel shroud 106 (see FIG. 17), the floor 23B of the counterbore 23 seats against the planar front surface 106B of the shroud 106. As discussed in more detail below, in some embodiments, a holding mechanism can provide for pulling the floor 23B of the counterbore 23 against, and holding it firmly in contact with, the front surface 106B of the shroud 106.

Figure 6:
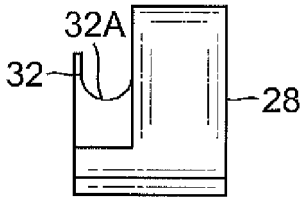
FIG. 6 is side elevation view of the mounting cleat of FIG. 5.
Figure 7:
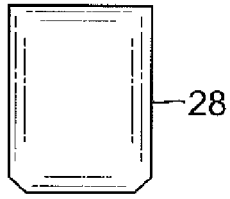
FIG. 7 is a rear elevation view of the mounting cleat of FIG. 5.
Figure 8:
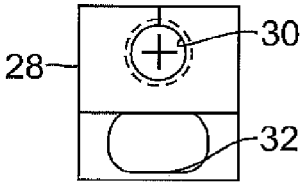
FIG. 8 is a top plan view of the mounting cleat of FIG. 5.
Figure 9:
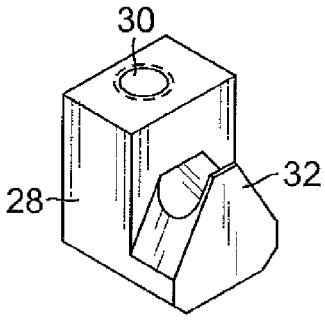
FIG. 9 is an upper front and side perspective view of the mounting cleat of FIG. 5.

Referring to FIGS. 1-4, in some embodiments, the holding mechanism can comprise a pair of threaded bolts 24 extending rearwardly from the base 12 through respective ones of a pair of diametrically opposing bolt apertures 26 contained therein, and an associated pair of cleats 28. With reference to FIGS. 5-9, each of the cleats 28 can include an opening 30 (see FIGS. 8, 9) into which a rear end portion of a respective one of the threaded bolts 24 is received, and a respective gripping hook 32 can be configured to grip a forward edge of a corresponding one of the circular openings 108 in the shroud 106 of the gun 100. With reference to FIG. 6, each of the hooks 32 of the cleats 28 can include an arcuate gripping surface 32A that is adapted to engage a correspondingly arcuate edge of the corresponding shroud hole 108. The cleats 28 are arranged such that advancement of the threaded bolts 24 into respective ones of the cleats causes the hook 32 of each cleat to grip a forward edge of the corresponding hole 108 in the shroud 106 of the gun 100 and the planar floor 23B of the counterbore 23 in the rear surface 22 of the base 12 to be pulled into contact with and held against the planar front surface 106B of the shroud 106. In one embodiment, the openings 30 of the cleats 28 can be threaded so as to receive a rear end portion of a respective one of the threaded bolts 24 in complementary threaded engagement. In another embodiment discussed below, the opening 30 of at least one of the cleats 28 can be a through-opening, i.e., unthreaded, and as illustrated in FIG. 1, a rear end portion of the corresponding threaded bolt 24 can be received in threading engagement with a threaded nut 29 disposed behind the corresponding unthreaded cleat 28.

With reference to FIGS. 2-4, in one advantageous embodiment, the opposing pairs of bolt apertures 26 in the base 12 can be slotted in the radial direction to accommodate gun shrouds 106 of different diameters, and in the example embodiment illustrated, the bolt apertures can comprise one of a plurality of diametrically opposing pairs of bolt apertures 26 arranged in a circumferential pattern around the base 12 in such a way as to enable the mounting cleats 28 of the mount 10 to grip the shrouds 106 of machine guns 100 having different shroud hole patterns. In the particular example embodiment illustrated, the opposing aperture 26 pair pattern comprises a first pair of apertures disposed on a horizontal axis, and two additional pairs respectively disposed on axes rotated approximately ±30 degrees relative to the horizontal axis. This enables the base 12, and hence, the accessory mounting tines 16 and 18, to be mounted in a variety of angular positions relative to the barrel 110 and shroud 106 of a gun 100.

Advantageously, the foregoing mount holding mechanism eliminates the use of conventional threaded "ball socket" lugs on gun shrouds 106 in which the dimensions of the shroud holes 108 are not always consistent, resulting in a misfit between the lugs and the shroud 106, thereby necessitating modifications to the shroud 106 to avoid damaging it. The mount 10 of the present disclosure clamps firmly against the planar front end 106B of the front bushing 106A of the shroud 106, where the dimensions are relatively consistent. Additionally, the foregoing mount holding arrangement enables the mount 10 to be used on guns 100 with different shroud hole 108 patterns, e.g., 6-hole or 8-hole shroud patterns. Further, the novel holding mechanism enables the accessory mount 10 to be installed on a machine gun 100 with a quick change barrel (QCB) 110, such as the gun 100 illustrated in FIG. 17.

As shown in FIG. 17, guns 100 with QCBs 110 include a handle 111 coupled to the barrel slightly forward of the shroud 106. The handle 111 is used to rotate the barrel 110 about the long axis of the barrel and through an angular displacement of about ±60 degrees so as to enable the rear end of the barrel 110 to be quickly engaged in or disengaged from a corresponding barrel attachment receptacle (not illustrated) in the receiver 102 of the gun 100. Guns 100 with QCBs 110 cannot be used with ballistic shields 112 of the type illustrated in FIGS. 19 and 20 because the handle 111 would interfere with the shield 112. On the other hand, any accessory mount 10 that is to be coupled to the front end of the shroud 106 of such guns must be adapted to accommodate such handles.

In the example accessory mount 10 of FIGS. 1-4, the mount includes features adapted to accommodate the handles 111 of a variety of guns 100 equipped with QCBs 110. As illustrated in FIGS. 1-3, the upper and lower accessory mounting tines 16 and 18 include respective right sides 16A and 18A that are generally coplanar with each other and parallel to a vertical plane passing through a center of the lumen 14 of the base 12. However, the respective left sides 16B and 18B of the tines 16 and 18 are respectively disposed in planes that pass through the center of the lumen 14 so as to subtend an angle of about 150 degrees between the two sides. Additionally, as shown in FIGS. 1 and 2, the front face 20B of the left side of the annular base 12 is recessed behind the front face 20A of the base, and further, includes a segment of an annular recess 21 adjacent to the central opening 14 of the base that is arranged to accommodate a rear end of a QCB handle 111. Further, the front face 20B of the of the left side of the annular base 12 includes a slot 27 straddling the middle bolt aperture 26 that enables the head of the threaded bolt 24 on the left side of the mount 10 to be recessed below the front face 20B of the base so as to clear the rear end of the QCB handle 111. When this arrangement is used, the aperture 30 of the corresponding cleat 28 on the left side of the mount 10 can be unthreaded, and a rear end portion of the left side threaded bolt 24 can be received in threading engagement with a threaded nut 29 disposed behind the corresponding unthreaded cleat 28, as illustrated in FIG. 1.

Figure 18:
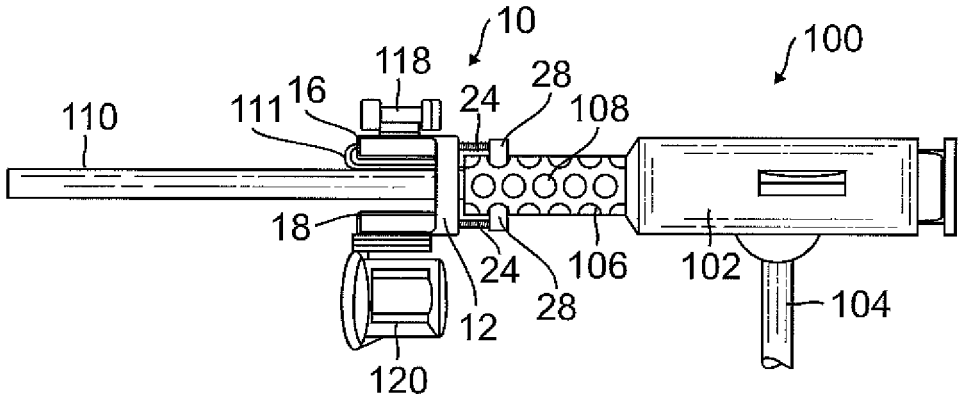
FIG. 18 is a partial left side elevation view of the .50 caliber heavy machine gun of FIG. 17 having an example embodiment of an accessory mount of the present disclosure mounted thereon, showing a gun sight and a spotlight mounted on the mount.

As illustrated in FIG. 18, in use, the mount 10 is mounted on the front end 106B of the shroud 106 of the machine gun 100 using an appropriate pair of the diametrically opposing bolt apertures 26 such that the accessory mounting tines 16 and 18 are disposed at an angle relative to the vertical, the base 12 is disposed rearward of the handle 111 of the QCB 110, and the handle 111 is free to rotate axially between the respective angulated left sides 16B and 18B of the two tines 16 and 18 with ample clearance. This enables the QCB 110 to be changed out, i.e., removed from the gun 100 and replaced with a new barrel 110, without having to remove the accessory mount 10 from the gun 100 or any of the accessories mounted thereon.

In this regard, referring again to FIGS. 1-4, the example accessory mount 10 further comprises one or more accessory mounting rails 34, 36 mounted on respective upper and lower surfaces of respective ones of the upper and lower tines 16 and 18 of the mount with, e.g., a plurality of threaded fasteners 38. In the particular example embodiment illustrated, the mounting rail 34 disposed on the upper surface of the forward end portion of the upper mounting tine 16 comprises a standard "Picatinny" rail, useful for mounting various types of gun accessories, such as a gun sight 118, e.g. a telescopic, laser, infrared (IR) or night vision device (NVD) gun sight, as illustrated in FIG. 18. The larger accessory mounting rail 36 shown mounted on the lower surface of the forward end portion of the lower tine 18 can comprise, for example, a larger rail of a proprietary design adapted to mount, e.g., a spotlight 120 for illuminating the gun's field of fire with IR and/or white light in dim or dark lighting conditions.

Figure 19:
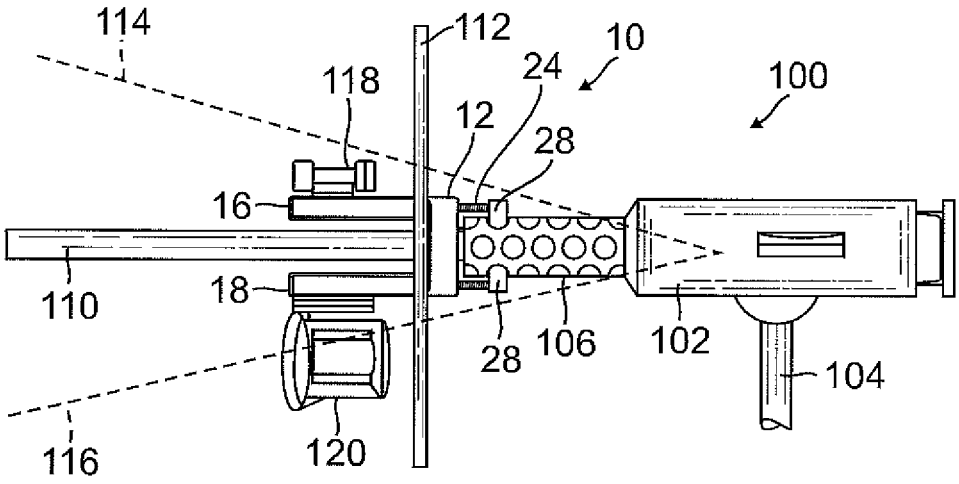
FIG. 19 is a partial left side elevation view of a .50 caliber heavy machine gun having a ballistic shield and an alternative example embodiment of an accessory mount of the present disclosure mounted thereon, showing a gun sight and a spotlight mounted on the mount.

It has been discovered that mounting a spotlight 120 on the lower surface of the lower tine 18 of the mount 10, and hence, below the barrel 110 of the gun 100, as illustrated in FIGS. 17-19, provides an important advantage relative to accessory mounts that position the spotlight level with or above the barrel. In particular, with extended firing of the gun, a cloud of smoke is produced by the atmospheric burning of the powder charges. If the spotlight 120 is mounted level with or above the barrel 110, the spotlight 120 will illuminate the smoke cloud, thereby resulting in a "whiteout" that obscures the gunner's view of the field of fire. However, by mounting the light 120 below the barrel 110 of the gun 100, the light does not illuminate the smoke, and the gunner retains a good view of the field of fire illuminated by the spotlight 120.

The accessory mount 10 can be manufactured by a variety of methods, including casting and machining, and can be fabricated of a variety of high strength materials. In one light weight yet robust embodiment capable of withstanding adverse battlefield environmental conditions and the shock and vibrations of the host gun 100 during extended firing, the base 12 and the upper and lower accessory mounting tines 16 and 18 can comprise a single, integral piece machined from a tube of an aluminum alloy, e.g. 6061-T6.

The cleats 28 are preferably also made of a strong metal, e.g., tool steel, and the accessory mounting rails 34, 36 can advantageously be made of a light weight but strong metal, e.g., a 6061-T5 aluminum alloy extrusion that is hard anodized for corrosion protection.

Figure 10:
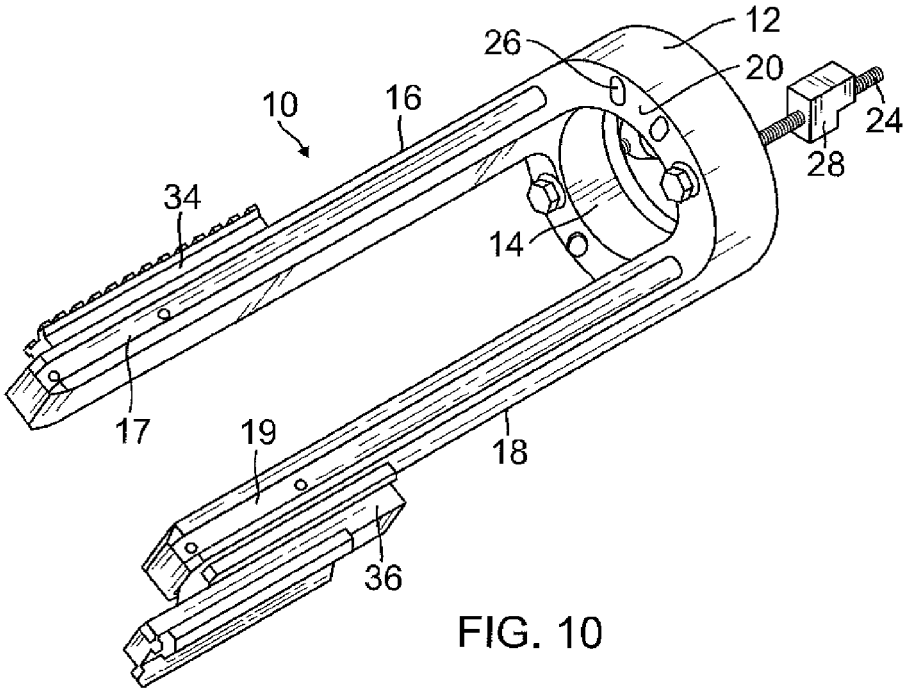
FIG. 10 is a front end and upper right side perspective view of example embodiment of another accessory mount, showing elongated tines of the mount useful on a heavy machine gun equipped with a ballistic shield.

FIG. 10 is a front and upper side perspective view of an alternative embodiment of the example accessory mount 10 adapted for use on a heavy machine gun 100 equipped with a ballistic shield 112, as discussed below in connection with FIGS. 19 and 20, and differs from the mount 10 illustrated in FIGS. 1-4 mainly in the respective lengths of the accessory mounting tines 16 and 18, which are elongated to accommodate the ballistic shield 112. Additionally, the long-tined mount 10 of FIG. 10 can omit the features that adapt the mount for use on a gun with a QCB 110, such as the angulated left sides 16B and 18B of the tines 16 and 18 and the recessed left front surface 20B and recess 21 of the embodiment of FIGS. 1-4, since as discussed above, QCBs 110 cannot be used with ballistic shields 112 of the type illustrated in FIGS. 19 and 20, because the QCB handle 111 would interfere with the ballistic shield 112. Accordingly, in the embodiment of FIG. 10, the right and left sides of the tines 16 and 18 are respectively coplanar, as are the right and left front faces of the annular mounting base 12.

FIGS. 11-14 illustrate an example embodiment of an optional accessory side mounting clamp 40 that can be used with the accessory mounts 10 of the present disclosure. As illustrated in the figures, the side mounting clamp 40 comprises an arcuate or C-shaped part having upper and lower ends 42, 44, each of which incorporates a laterally facing land 46 that is adapted to fit into a corresponding one of a pair of complementary elongated grooves 17 and 19 (see FIG. 10) extending along opposite sides of each of the upper and lower tines 16 and 18 of the mount 10. The clamp 40, in turn, can include an elongated groove 50 extending along one side that is adapted to receive an accessory mounting rail 34 for mounting a gun accessory, such as a gun sight 118, on a side of the accessory mount 10 in the manner described below, and can also include one or more lightening holes 52 for weight reduction.

Figure 11:
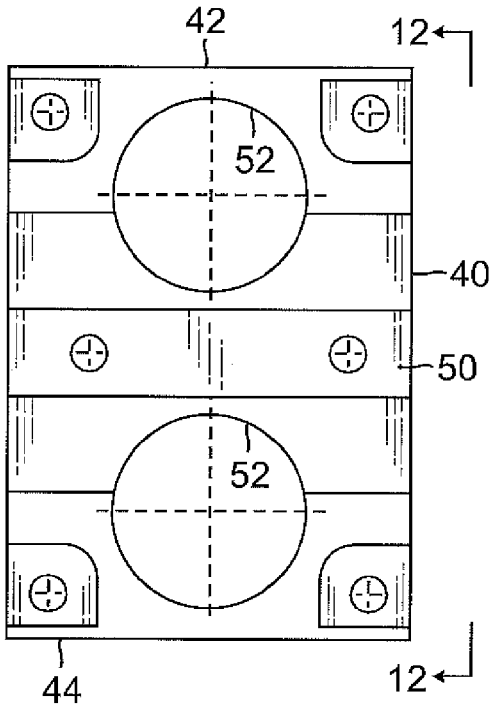
FIG. 11 is a side elevation view of an example embodiment of an optional C-shaped accessory side mounting clamp that can be used with the accessory mounts described herein.
Figure 12:
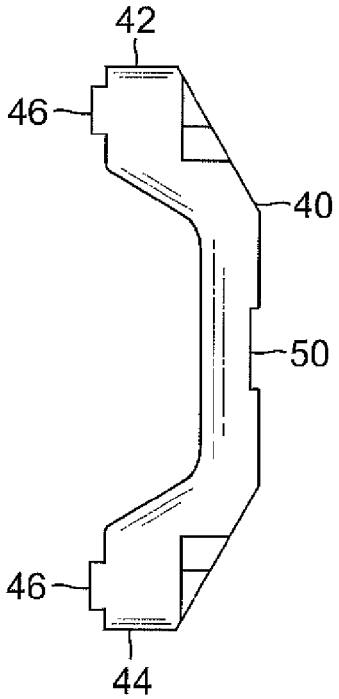
FIG. 12 is an end view of the accessory side mounting clamp of FIG. 11, as seen along the lines of the section 12-12 taken therein.
Figure 13:
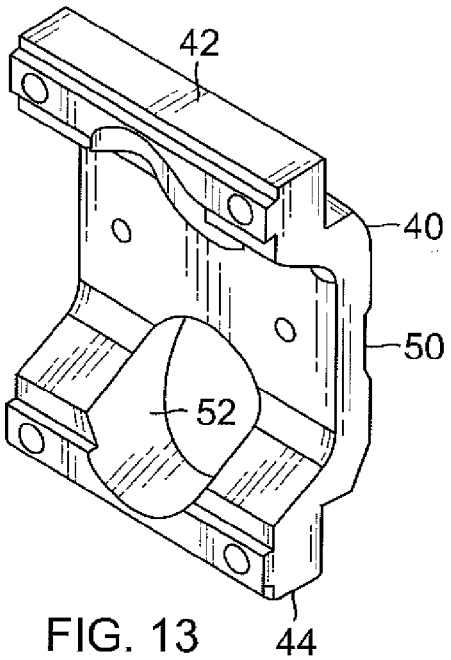
FIG. 13 is an upper front and inner side perspective view of the accessory side mounting clamp of FIG. 11.
Figure 14:
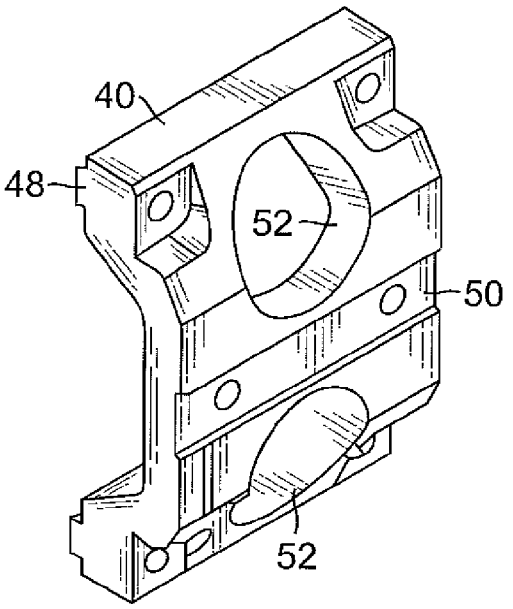
FIG. 14 is an upper front and outer side perspective view of the accessory side mounting clamp of FIG. 11.

As can be seen in the front elevation view of the accessory side mounting clamp 40 of FIG. 11, the clamp 40 can be bilaterally symmetrical about both vertical and horizontal central axes, thereby rendering the clamp 40 usable on either side of a mount 10. The clamp 40 can be fabricated by a variety of manufacturing techniques and from a variety of materials. In one embodiment, the clamp 40 is machined from an aluminum alloy, e.g., 6061-T6, and then can be hard anodized for corrosion resistance.

Figure 15:
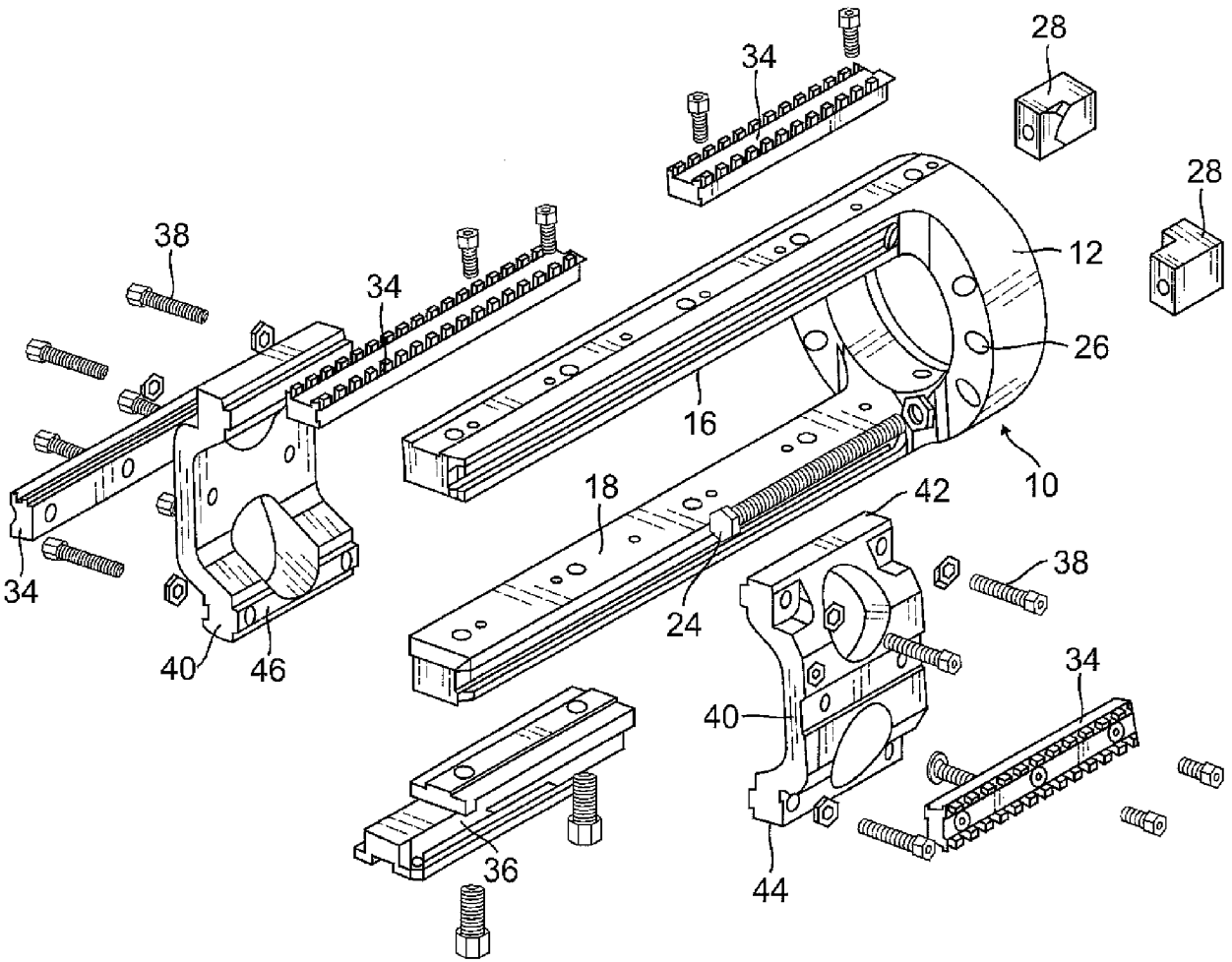
FIG. 15 is an exploded perspective view of the accessory mount of FIG. 10, showing the mounting thereto of a pair of the accessory side mounting clamps of FIG. 11.
Figure 16:
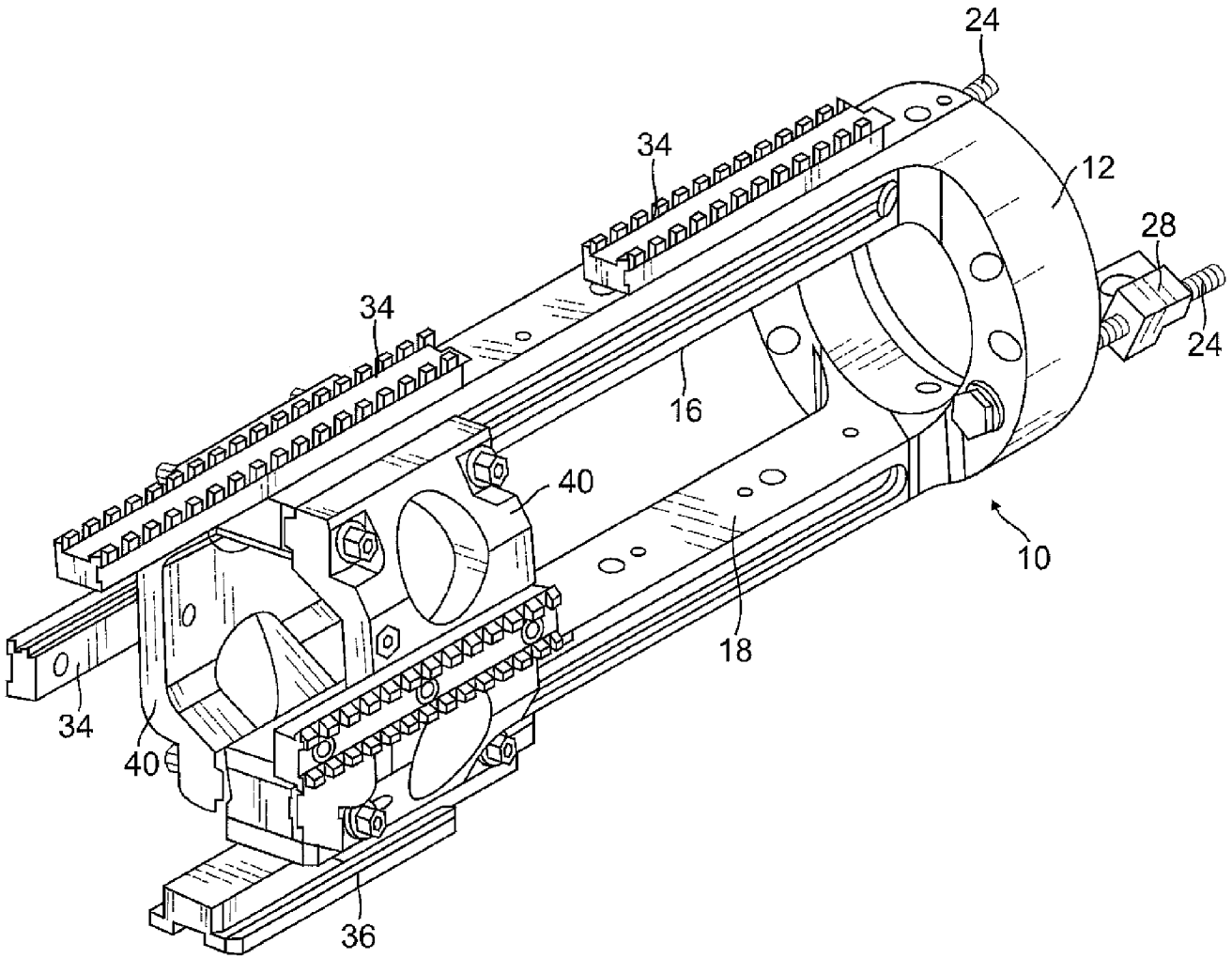
FIG. 16 is a perspective view of the accessory mount and the accessory side mounting clamps of FIG. 15, shown in the assembled condition.

FIG. 15 is an exploded upper front and side perspective view of the elongated-tine accessory mount 10 of FIG. 10, with a pair of the optional accessory side mounting clamps 40 mounted on opposite sides thereof, and FIG. 16 is a similar view of the accessory mount 10 and side mounting clamps 40 shown in a fully assembled state. As can be seen in these figures, the laterally facing lands 46 on the upper and lower ends 42 and 44 of the clamps 40 are respectively disposed in the grooves 17 and 19 in the sides of corresponding ones of the upper and lower tines 16 and 18 of the mount 10 with, e.g., a plurality of threaded fasteners 38, and an accessory mounting rail 34, such as a Picatinny rail, is in turn mounted in the groove 50 on the outer side of each of the mounting clamps 40. As can be seen in the figures, any one of the accessory mounting rails 34, 36 can be mounted on its respective mounting surface such that the rail is either flush with or extends forwardly of the front end of the mount 10.

As will be appreciated, the foregoing "double-sided" arrangement enables four gun accessories, such as gun sights 118 or spotlights 120, to be mounted to a heavy machine gun 100 simultaneously, disposed at 90 degree increments relative to each other. Also, it should be understood that, although the example embodiment illustrated incorporates two of the optional accessory side mounting clamps 40, i.e., one on each side of the mount 10, it is also possible to use only a single clamp 40 on either side of the mount 10 for the side-mounting of a single accessory.

Figure 20:
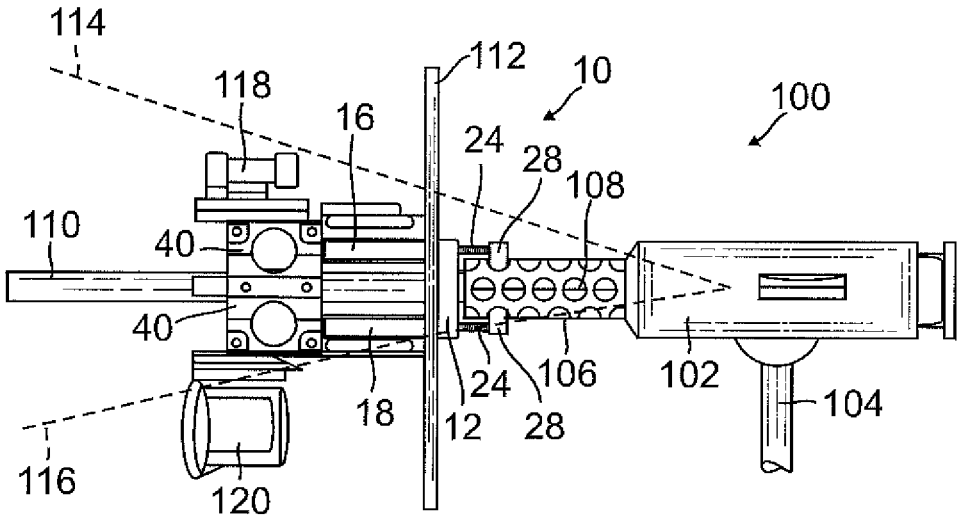
FIG. 20 is a partial left side elevation view of a .50 caliber heavy machine gun having a ballistic shield and an example embodiment of an accessory mount and a pair of the accessory side mounting clamps of the present disclosure mounted thereon, showing a gun sight and a spotlight mounted on the accessory mount.

FIGS. 18-20 are partial left side elevation views of a heavy machine gun 100 having various embodiments of the accessory mount 10 of the present disclosure mounted thereon. The gun 100 can comprise, for example, a Browning .50 caliber M2HB heavy machine gun. The gun includes a receiver 102 that is typically mounted on a stand 104 of a type that enables a barrel 110 of the gun to be traversed left and right and elevated up and down. The gun further includes a shroud 106 that incorporates a plurality of circular holes 108 disposed in a regular pattern therein, and the elongated, rifled barrel 110 that is supported by the shroud 106 and receiver 102 to move axially in a reciprocating manner relative to the shroud and receiver, and hence, an accessory mount 10 mounted thereto, during firing of the gun 100.

As illustrated in FIGS. 17 and 18, the gun 100 can include a QCB 110 incorporating a handle 111 used to rotate the barrel relative to the receiver 102 in order to change out the barrel 110. As discussed above, the short-tined embodiment of mount 10 illustrated in FIGS. 1-4 enables a pair of accessories, such as a gun sight 118 and a spotlight 120 to be mounted to the gun, and further, enables the QCB 110 to be removed from the gun 100 and replaced with a new barrel, without having to remove either the accessory mount 10 or the accessories mounted thereon.

Alternatively, as illustrated in the embodiments of FIGS. 19 and 20, the gun 100 can be equipped with a ballistic shield 112 having an elongated vertical slot within which the barrel 110 of the gun 100 is pivotally disposed for a continuous pivotal movement between positions of maximum and minimum elevation 114 and 116, indicated by the dashed lines in the figures. The ballistic shield 112, which may be made a heavy thickness of steel, is fixed relative to the gun and is disposed so as to protect the gunner from enemy fire.

The gun 100 illustrated in FIGS. 17 and 18 does not include a ballistic shield, and consequently, can utilize the short-tined version of the accessory mount 10 of FIG. 1, whether it includes a QCB 110 and handle 111 or not. As described above, the mount 10 can be mounted to the gun by disposing the recess 23 of the annular base 12 of the mount concentrically over the bushing 106A at the front of the shroud 106 of the gun, with the upper and lower tines 16 and 18 of the mount disposed one above the other, or tilted at an appropriate angle relative to a QCB barrel handle 111, if any, and the mount can then be slid rearwardly until the floor 23B of the recess abuts the nose, or front surface 106B of the shroud 106.

The cleats 28 disposed near the ends of the rearwardly extending threaded bolts 24 can then be inserted into respective ones of adjacent circular holes 108 in the shroud 106 until the arcuate surface 32A of the gripping hook 32 of each of the cleats 28 is disposed adjacent to a front edge of the corresponding shroud hole. The threaded bolts 24 can then be turned so as to advance them into the respective cleats 28, or alternatively, into respective nuts 29 disposed behind the cleats, thereby pulling the mount 10 toward the shroud 106, until the floor 23B of the recess 23 in the rear of the annular base 12 of the mount 10 is pulled against and held firmly in contact with the front surface 106B of the shroud 106. As illustrated in FIG. 18, an accessory, such as a gun sight 118 or a spotlight 120, can then be mounted on the mounting rails of each of the upper and lower tines 16 and 18 of the mount 10.

As those of skill in the art will appreciate, when the gun 100 includes a ballistic shield 112, as illustrated in the embodiments of FIGS. 19 and 20, the upper and lower tines 16 and 18 of the mount 10 must protrude forwardly through the narrow vertical slot in the shield 112 so that the accessories can be mounted forward of the shield 112. In such machine gun embodiments, the elongated-tine version of the mount 10, such as illustrated in FIG. 10, is therefore indicated, and as those of some skill in the art will appreciate, the respective lengths of the upper and lower tines 16 and 18 and the respective longitudinal mounting positions of the accessory mounting rails 34, 36 respectively mounted thereon must be such that, during pivotal movement of the barrel 110 between the two extreme positions of elevation 114 and 116 of the barrel 110 shown in FIGS. 19 and 20, the accessories 118 and/or 120 respectively mounted on the upper and/or lower tines 16 and 18 will clear the ballistic shield 112 at every position of the barrel 110. Additionally, as illustrated in FIG. 20, if desired, one or two of the optional C-shaped mounting clamps 40 can be respectively mounted on the sides of the long-tined version of the mount 10 and used to mount one or two additional accessories on the sides of the mount 10.

Figure 21:
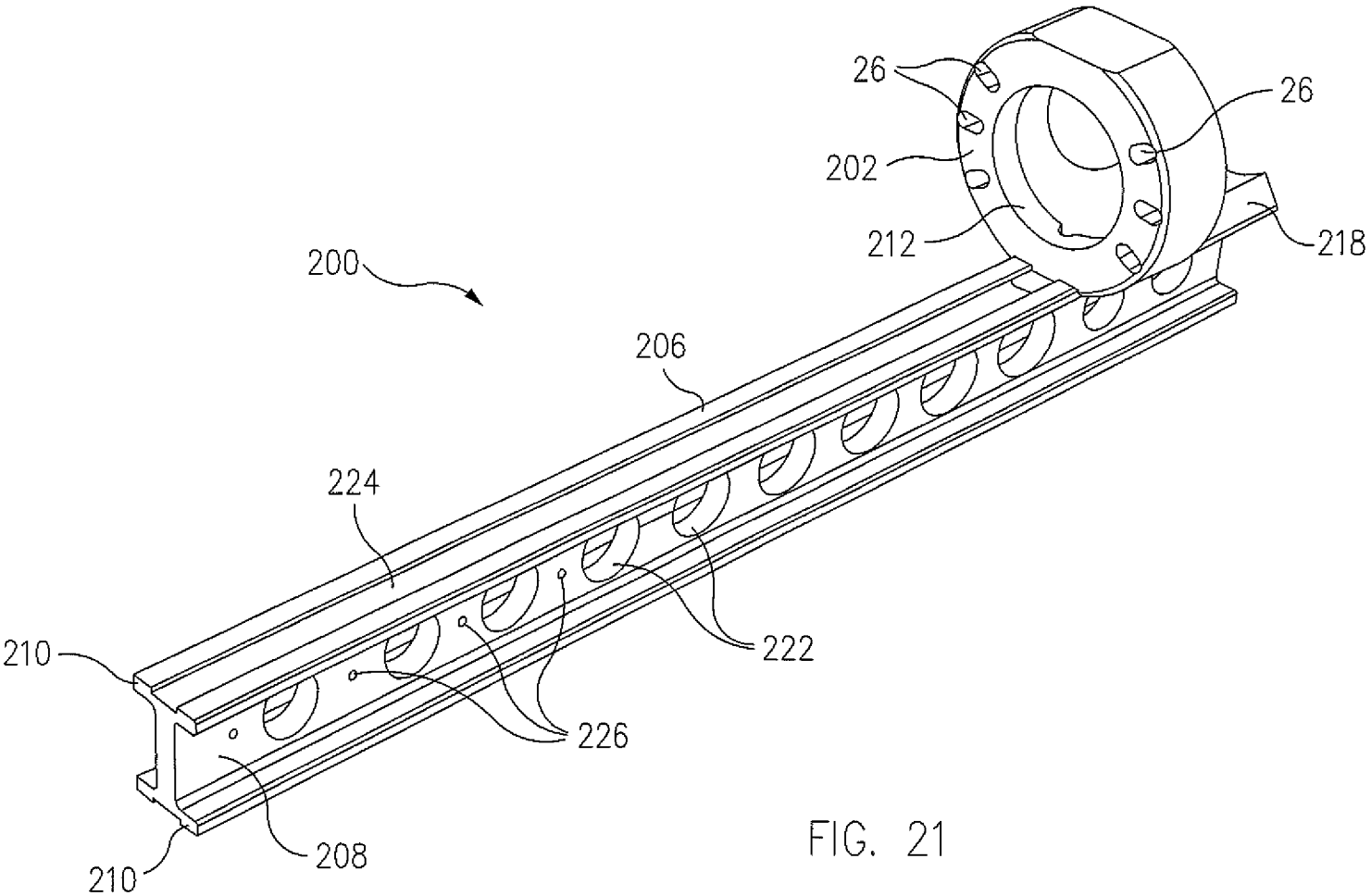
FIG. 21 is a front end and left side perspective view of an example embodiment of another machine gun accessory mount.
Figure 27:
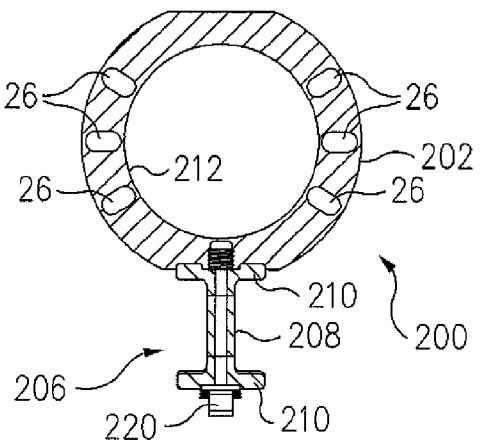
FIG. 27 is a cross-sectional view through the accessory mount of FIG. 22, as seen along the lines of the section 27-27 taken therein.
Figure 28:
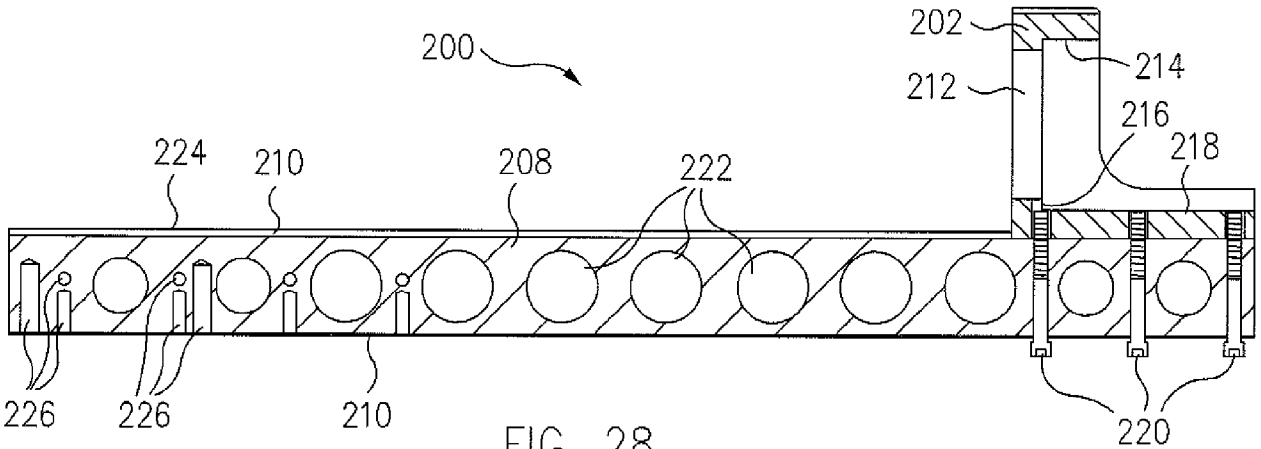
FIG. 28 is a cross-sectional view through the accessory mount of FIG. 23, as seen along the lines of the section 28-28 taken therein.
Figure 29:
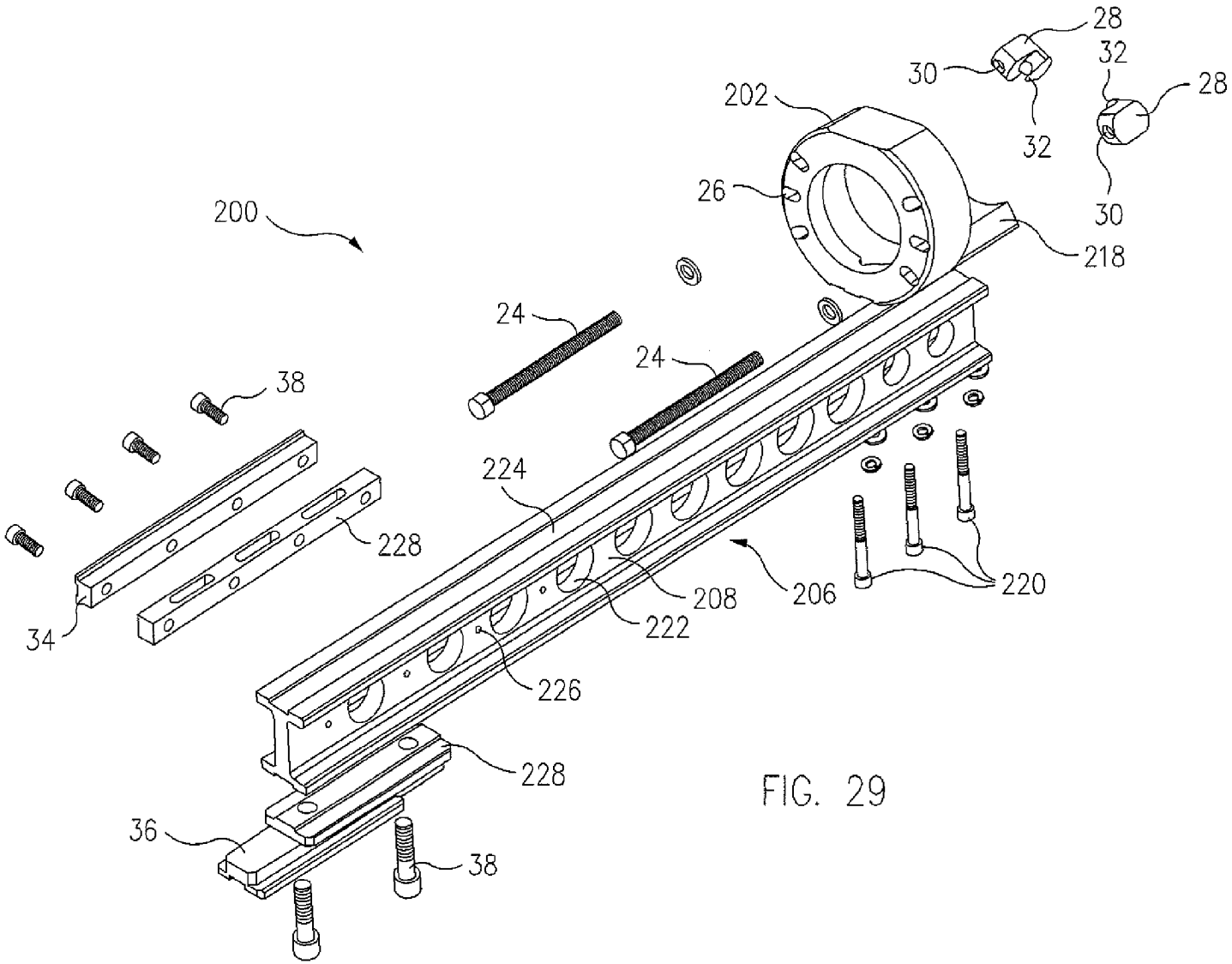
FIG. 29 is an exploded front end and left side perspective view of the accessory mount of FIG. 21, showing details including the attachment of accessory mounting rails to the accessory mount.
Figure 30:
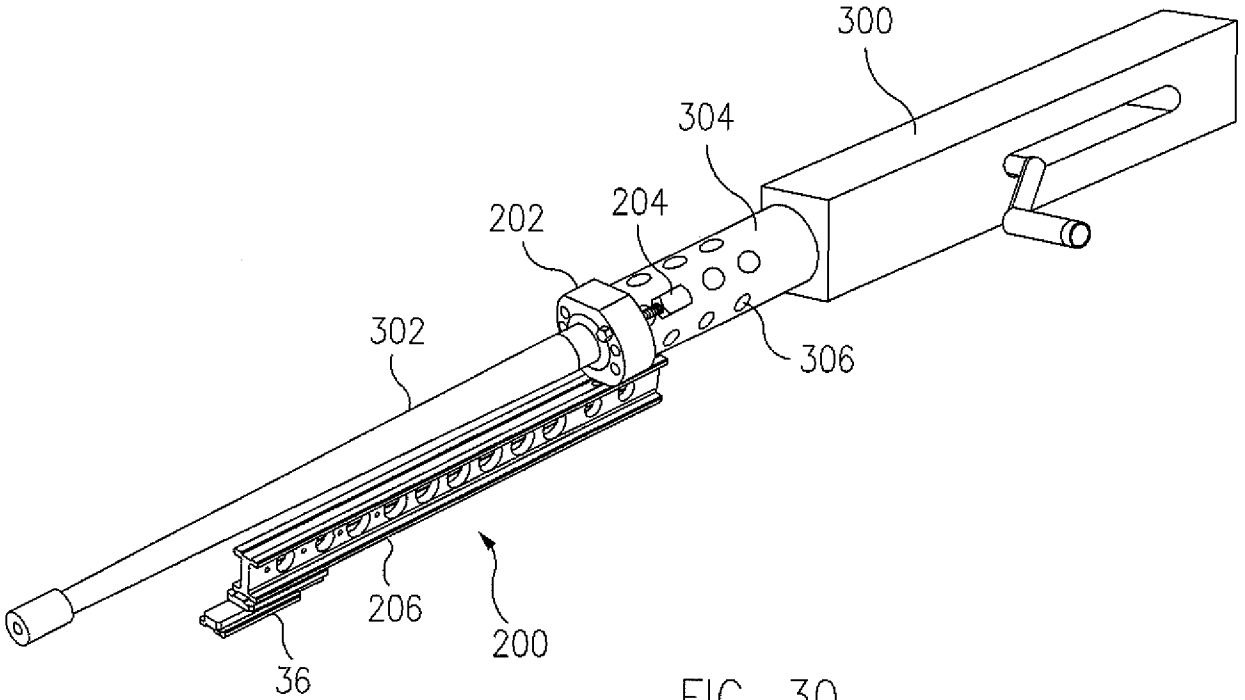
FIG. 30 is a front end and left side perspective view of the accessory mount of FIG. 21, showing the accessory mount mounted on a machine gun.

Another example embodiment of a machine gun accessory mount 200 is illustrated in the front end and left side perspective view of FIG. 21. FIGS. 22-26 are left side elevation, top plan, bottom plan, front end elevation, and rear end elevation views of the accessory mount 200, respectively. FIG. 27 is a cross-sectional view through the accessory mount 200 of FIG. 22, as seen along the lines of the section 27-27 taken therein. FIG. 28 is a cross-sectional view through the accessory mount 200 of FIG. 23, as seen along the lines of the section 28-28 taken therein. FIG. 29 is an exploded front end and left side perspective view of the accessory mount 200, showing details including the attachment of accessory mounting rails 34, 36 to the accessory mount 200. FIG. 30 is a front end and left side perspective view showing the accessory mount 200 mounted on an associated machine gun 300 (e.g., a Browning .50 caliber M2HB heavy machine gun in one embodiment). The accessory mount 200 may be used with other guns in other embodiments.

As illustrated in various figures, the accessory mount 200 can comprise a base 202 configured for attachment of the accessory mount 200 to the gun 300, a holding mechanism 204 (see FIG. 30) for fixing the position of the base 202 in relation to the gun 300, and an elongated accessory mounting arm 206 (e.g., a tine in one embodiment) coupled to a lower circumferential surface of the base 202 and extending forwardly therefrom. The accessory mounting arm 206 can comprise an elongated beam having a vertical web 208 with at least one flange 210 disposed at an upper and/or a lower end thereof. In the particular example embodiment illustrated, the accessory mounting arm 206 includes two flanges 210, one at each of the upper and lower ends of its web 208, like an I-beam or a T-beam.

Figure 26:
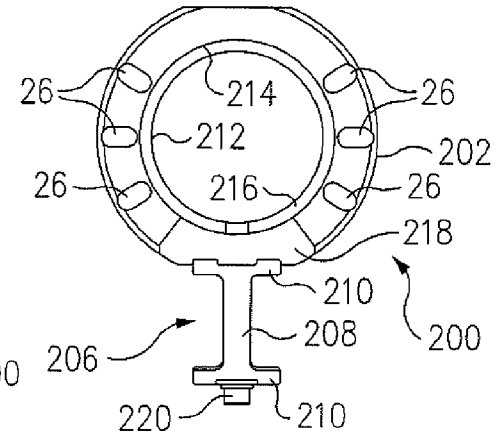
FIG. 26 is a rear end elevation view of the accessory mount of FIG. 21.
Figure 25:
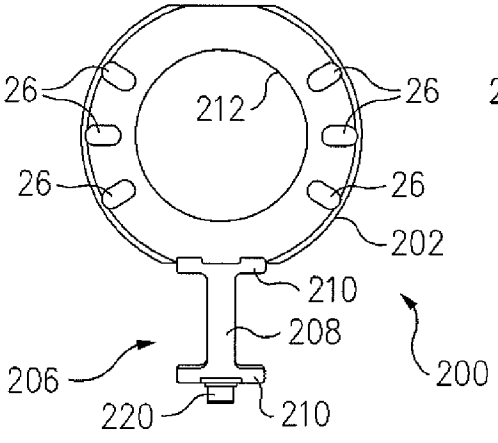
FIG. 25 is a front end elevation view of the accessory mount of FIG. 21.

In some embodiments, the base 202 can comprise an annular structure having a circular central opening 212 configured to be disposed concentrically over the barrel 302 of the gun 300 and a concentric counterbore 214 extending into a rear surface thereof, as illustrated in, e.g., FIGS. 26 and 28. The counterbore 214 can define an annular, planar floor 216 that is configured to be disposed concentrically over a front end of a shroud 304 of the gun 300, with the floor 216 of the counterbore 214 disposed against a planar front surface of the shroud 304 and held there securely with the holding mechanism 204.

In some embodiments, the holding mechanism 204 may be implemented by, for example, threaded bolts 24 (see FIG. 29), threaded fasteners, or any other appropriate structures extending rearwardly from the base 202 through respective ones of a pair of bolt apertures 26 contained therein, and a corresponding pair of cleats 28 of the type discussed above in connection with FIGS. 5-9, each having an opening 30 through which a rear end portion of a respective one of the threaded bolts 24 extends, and a hook 32 adapted to grip an edge of a corresponding hole 306 in the shroud 304 of the gun 300. The cleats 28 can be arranged such that advancement of the threaded bolts 24 into respective ones of the cleats 28 causes the hook 32 of each cleat 28 to grip the edge of the corresponding hole 306 in the shroud 304 of the gun 300, and the planar floor 216 of the counterbore 214 in the rear surface of the base 202 to be pulled into contact with and held firmly against the planar front surface of the shroud 304.

Figure 22:
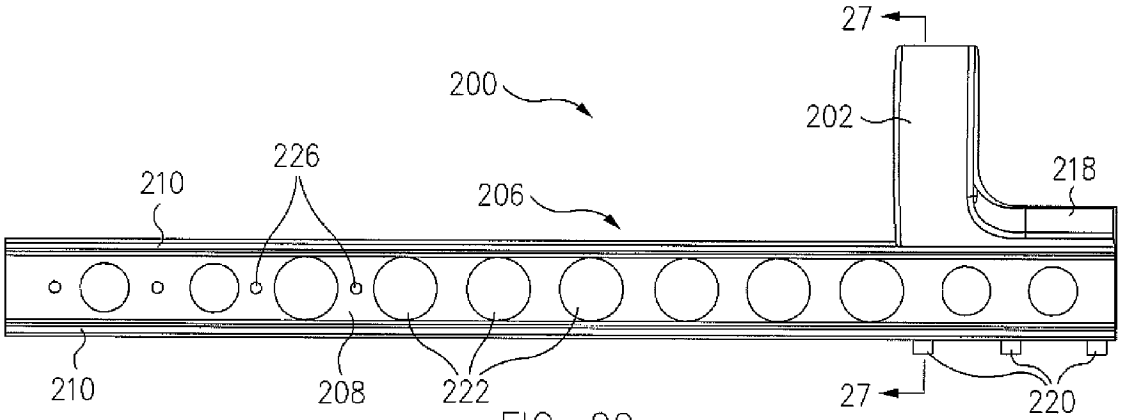
FIG. 22 is left side elevation view of the accessory mount of FIG. 21.
Figure 23:
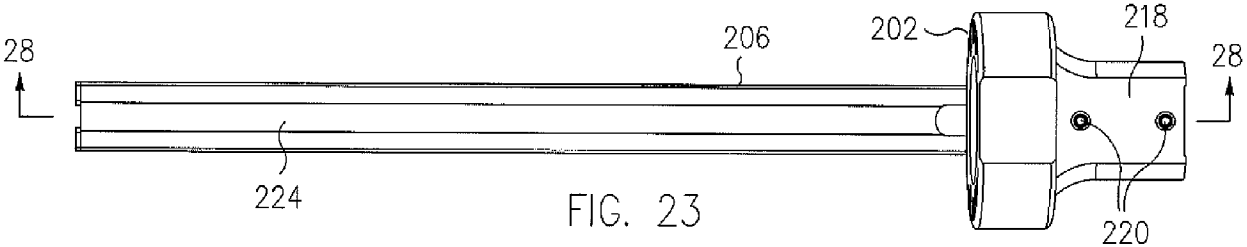
FIG. 23 is a top plan view of the accessory mount of FIG. 21.
Figure 24:
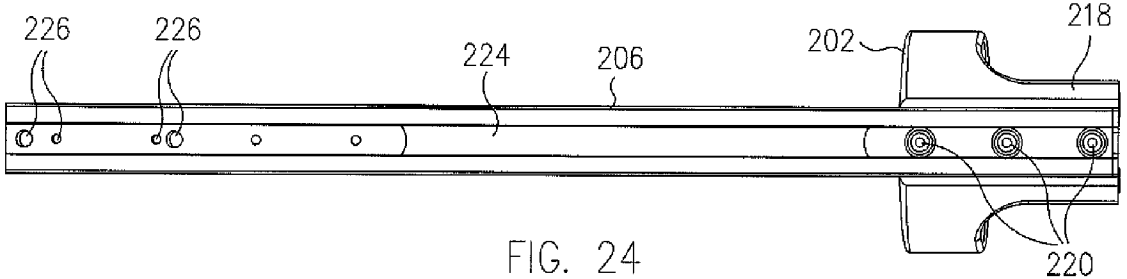
FIG. 24 is a bottom plan view of the accessory mount of FIG. 21.

As illustrated in, e.g., FIGS. 22-24, in some embodiments, the base 202 can include a rearwardly extending tailpiece 218, and in such embodiments, the accessory mounting arm 206 can be coupled to both the base 202 and the tailpiece 218, by, e.g., a welded joint, a brazed joint, an adhesive joint or at least one fastener 220 (e.g., implemented by at least one threaded bolt or other appropriate structure). The at least one fastener 220 can comprise, for example, a rivet, a dowel pin, a roll pin, a coiled spring pin or, as illustrated in the figures, one or more threaded fasteners, such as Allen-head cap screws.

As illustrated in, e.g., FIGS. 22 and 28, in one example embodiment, the web 208 of the accessory mounting arm 206 can advantageously include one or more lightening holes 222 extending therethrough to reduce the weight of the accessory mount 200. Accessory mounting arm 206 may be implemented with different numbers and sizes of lightening holes 222 as shown for different embodiments.

In another advantageous embodiment, the accessory mounting arm 206 can comprise an extrusion of, e.g., an aluminum alloy, for economy of manufacturing purposes, and which in some embodiments, can be anodized after finish machining for robust corrosion protection of the accessory mount 200.

Thus, in one embodiment, a method for fabricating the accessory mount 200 can include extruding the accessory mounting arm 206, then forming the base 202 and machining the features of the accessory mounting arm 206, such as the lightening holes 222, using, e.g., computer numerical control (CNC) machine tools, then fastening the rear end portion of the accessory mounting arm 206 to the base 202 with, e.g., threaded fasteners 220, such that the front end portion of the accessory mounting arm 206 extends forwardly from the base 202, as illustrated in, e.g., FIGS. 21 and 22. In some embodiments, both the base 202 and the accessory mounting arm 206 (as well as other bases, brackets, and arms described herein) can be made of an aluminum alloy, e.g., 7075-T6, 2024-T6, or 6061T6, which can be, e.g., hard anodized for robust protection against corrosion and abrasion.

As illustrated in FIGS. 21 and 23-24, in some embodiments, the flange(s) 210 of the web 208 of the accessory mounting arm 206 can include a longitudinal groove 224 in an upper and/or a lower surface thereof, and as illustrated in, e.g., FIGS. 22, 24 and 28, a side wall of the web 208 and/or a floor of the longitudinal groove(s) 224 of the flange(s) 210 can be provided with a plurality of accessory rail mounting apertures 226 formed therein. Any desired pattern or number of accessory rail mounting apertures 226 may be provided in various embodiments.

As illustrated in FIGS. 29 and 30, in an example use of the accessory mount 200, one or more accessory mounting rails 34, 36, e.g., a Picatinny rail 34, can be mounted on a surface, e.g., on the respective floor(s) of the longitudinal groove(s) 224 (see FIG. 24) and/or one or both of the sidewalls of the web 208 (see FIG. 22), at a forward end portion of the accessory mounting arm 206 using, e.g., threaded fasteners 38 and the accessory rail mounting apertures 226. The mounting rail(s) 34, 36 can then be used with the accessory mount 200 to secure one or more accessories to the gun 300, as illustrated and described with regard to the accessory mount 10. As illustrated in FIG. 29, in some embodiments, spacers 228 can be used to space the mounting rails 34, 36 a selected distance above the surfaces upon which they respectively mount.

As discussed above in connection with FIGS. 18-20, the types of accessories that can be mounted to the gun 300 using the accessory mount 200 can include, for example, a gun sight 108 and/or a lighting device 120. The gun sight 108 can comprise, e.g., a telescopic sight, a laser sight, an infrared (IR) sight or a night vision device (NVD) gun sight. The lighting device 120 can comprise, for example, a flashlight or a flood light, including but not limited to white, amber, IR, and/or other versions of the foregoing corresponding to various wavelengths of light.

With reference to, e.g., FIGS. 17, 29, and 30, as those of skill in the art will appreciate, since the accessory mount 200 eliminates a second mounting arm (e.g., tine) situated above the barrel 302 of the gun 300, the base 202 and the omitted upper arm of the accessory mount 200 cannot interfere with the handle 111 of a gun having a quick change barrel (QCB), such as the gun 100 illustrated in FIG. 17, and accordingly, the accessory mount 200 is therefore fully compatible with such guns and enables the barrel 302 to be removed from such guns without the necessity of first removing the accessory mount 200.

Figure 31:
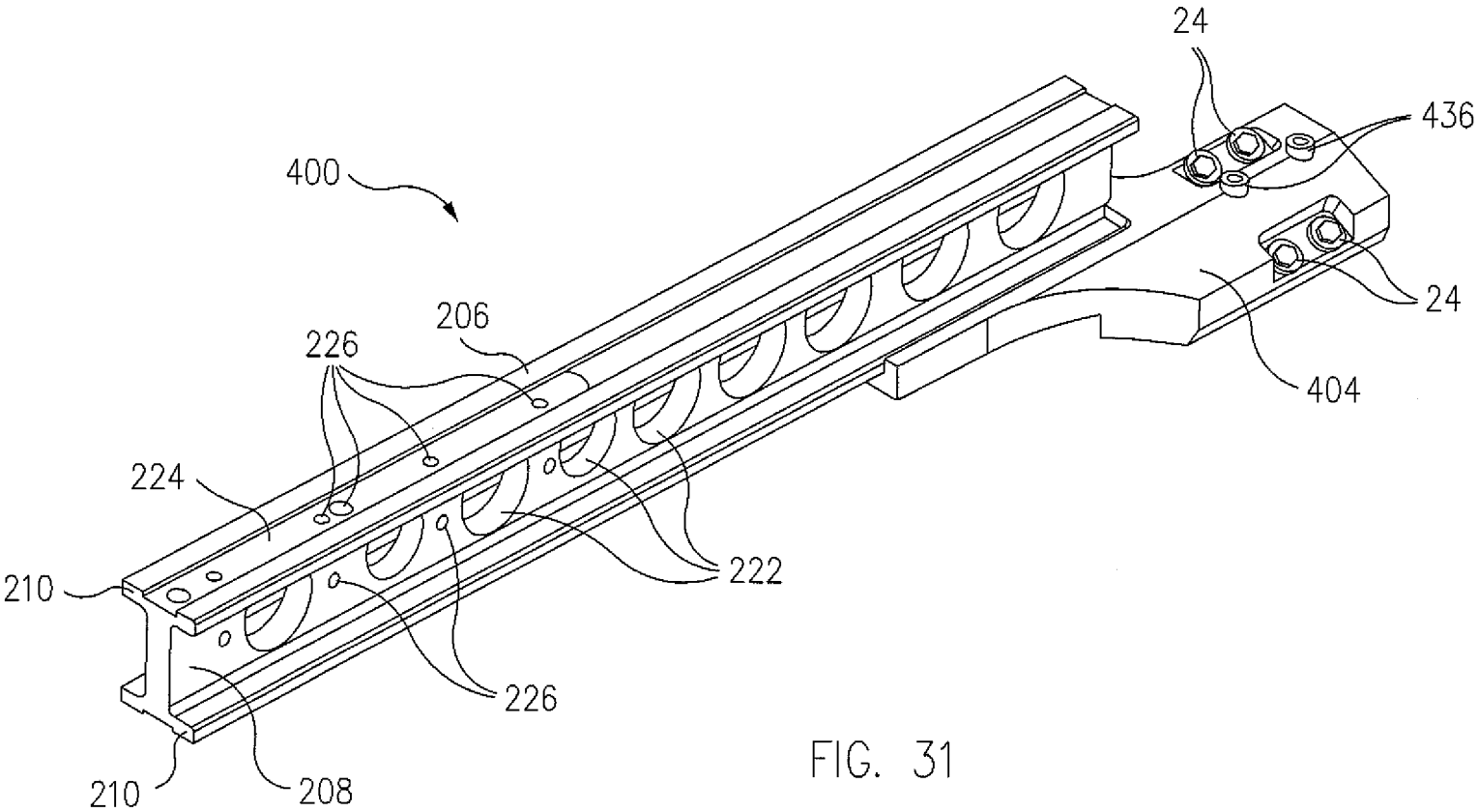
FIG. 31 is a front end and left side perspective view of an example embodiment of another machine gun accessory mount.
Figure 32:
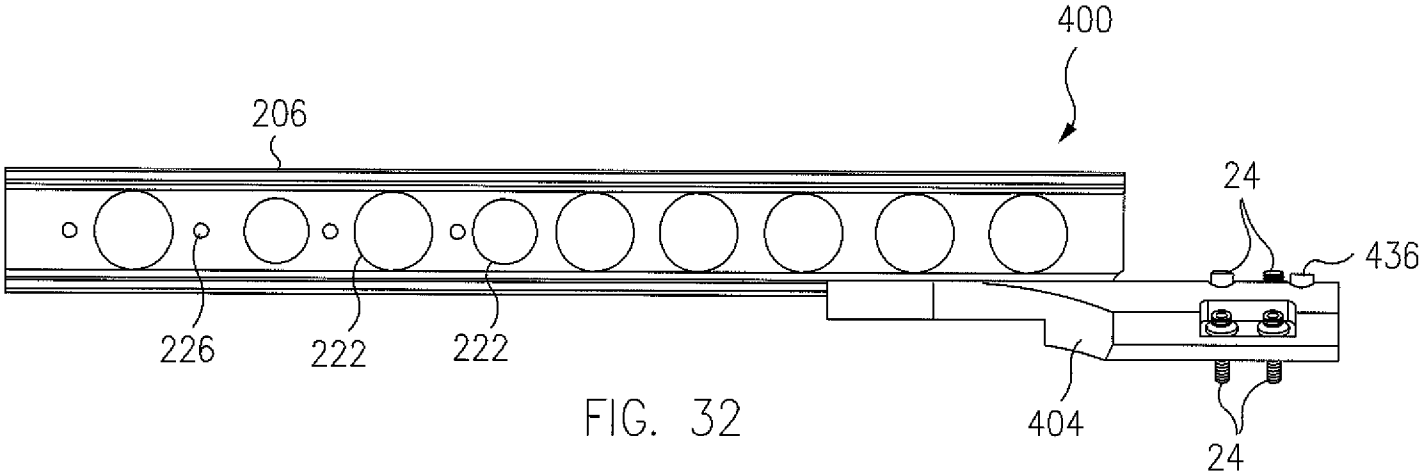
FIG. 32 is a left side elevation view of the accessory mount of FIG. 31.
Figure 33:
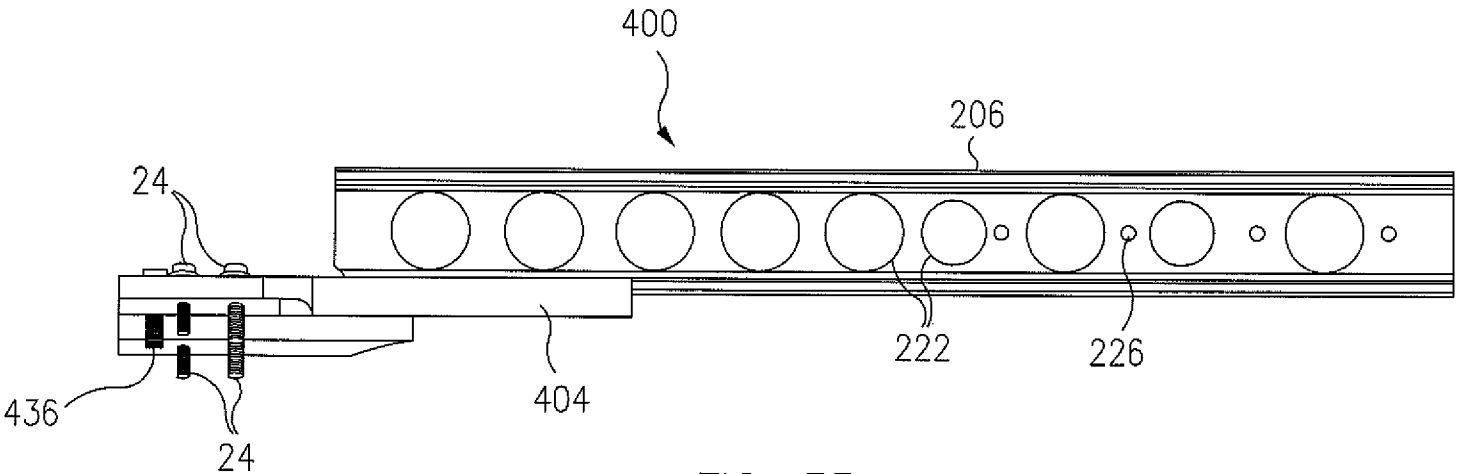
FIG. 33 is a right side elevation view of the accessory mount of FIG. 31.
Figure 34:
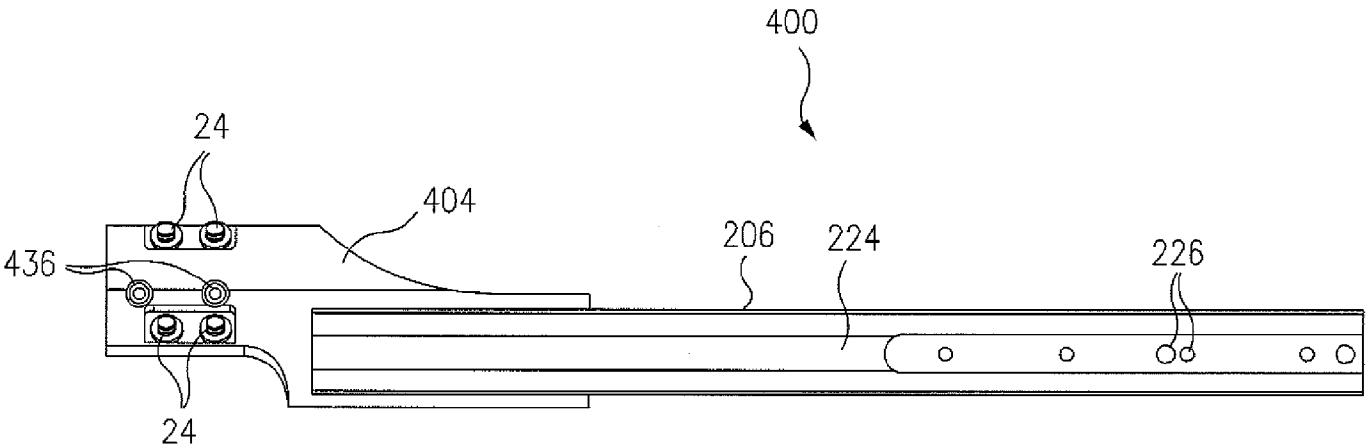
FIG. 34 is a top plan view of the accessory mount of FIG. 31.

Another example embodiment of a machine gun accessory mount 400, useful in conjunction with, for example, so-called "miniguns," such as the M134 minigun 402 (see FIGS. 46B-D), is illustrated in the front end and left side perspective view of FIG. 31. The accessory mount 400 may be used with other guns in other embodiments. FIGS. 32-37 are left side elevation, right side elevation, top plan, bottom plan, front end elevation, and rear end elevation views of the accessory mount 400, respectively.

Similar to the accessory mount 200 of FIG. 21, the accessory mount 400 can comprise a base 404 configured for attachment of the accessory mount 400 to the gun 402, a holding mechanism (e.g., threaded bolts 24, threaded fasteners, or any other appropriate structures) for fixing the position of the base 404 in relation to the gun 402, and an elongated accessory mounting arm 206 coupled to the base 404 and extending forwardly therefrom. In this regard, FIGS. 38-45 are various views of the base 404. In some embodiments, the accessory mounting arm 206 may be implemented in the same or similar manner as illustrated and described for the accessory mount 200.

Figure 46A:
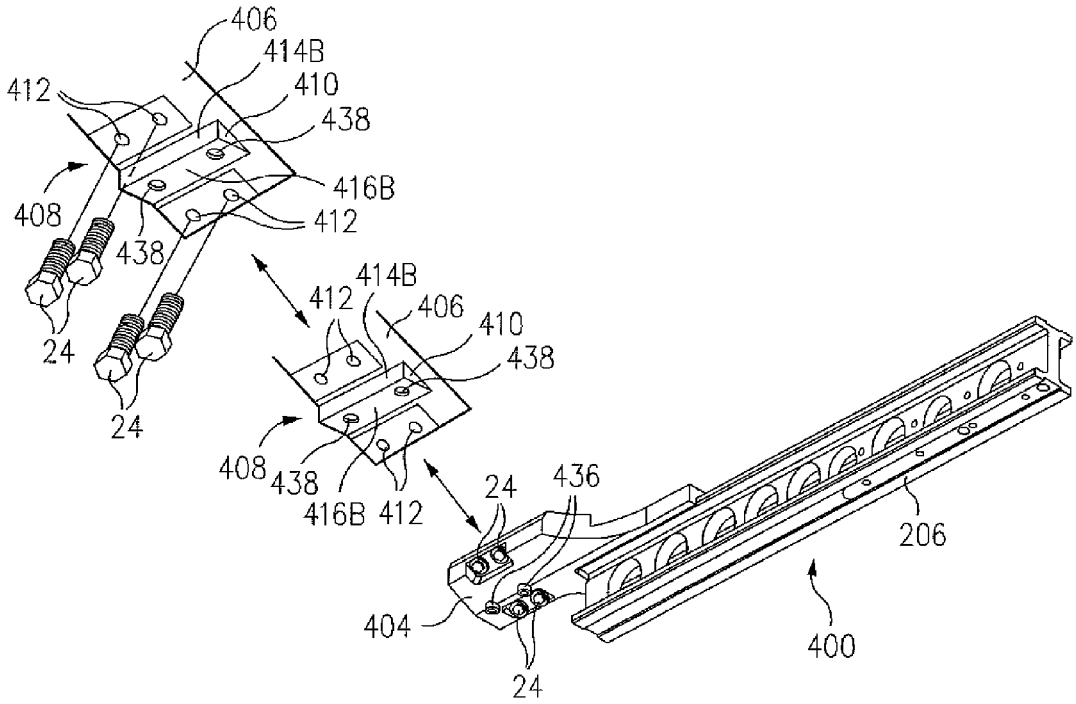
FIG. 46A is a front end and right side perspective view of the accessory mount of FIG. 31, showing its mounting and alignment relationship to mounting and alignment features of a yoke.
Figure 46B:
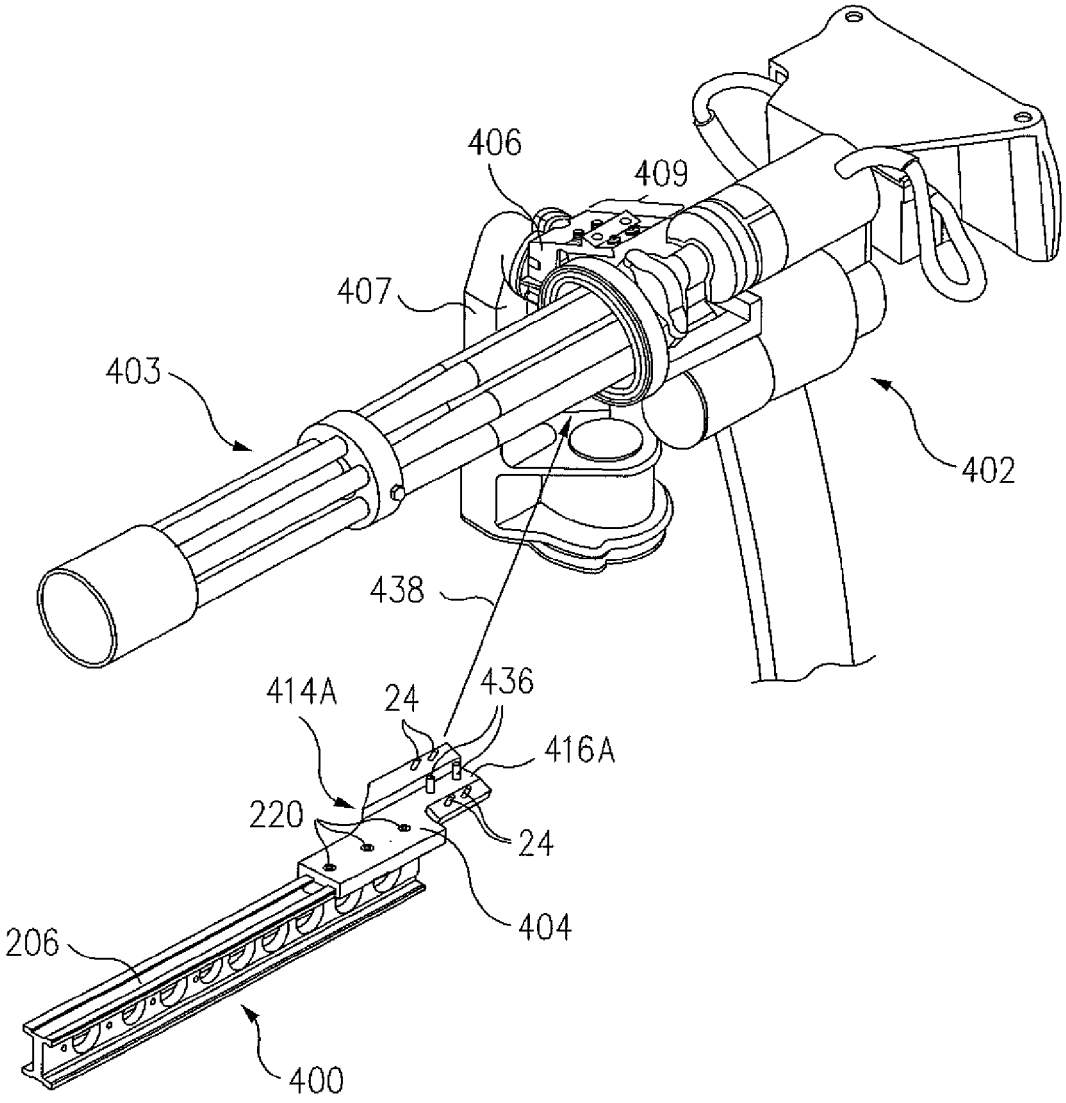
FIG. 46B is a front end and left side perspective view of the accessory mount of FIG. 31 and an example minigun.
Figure 46C:
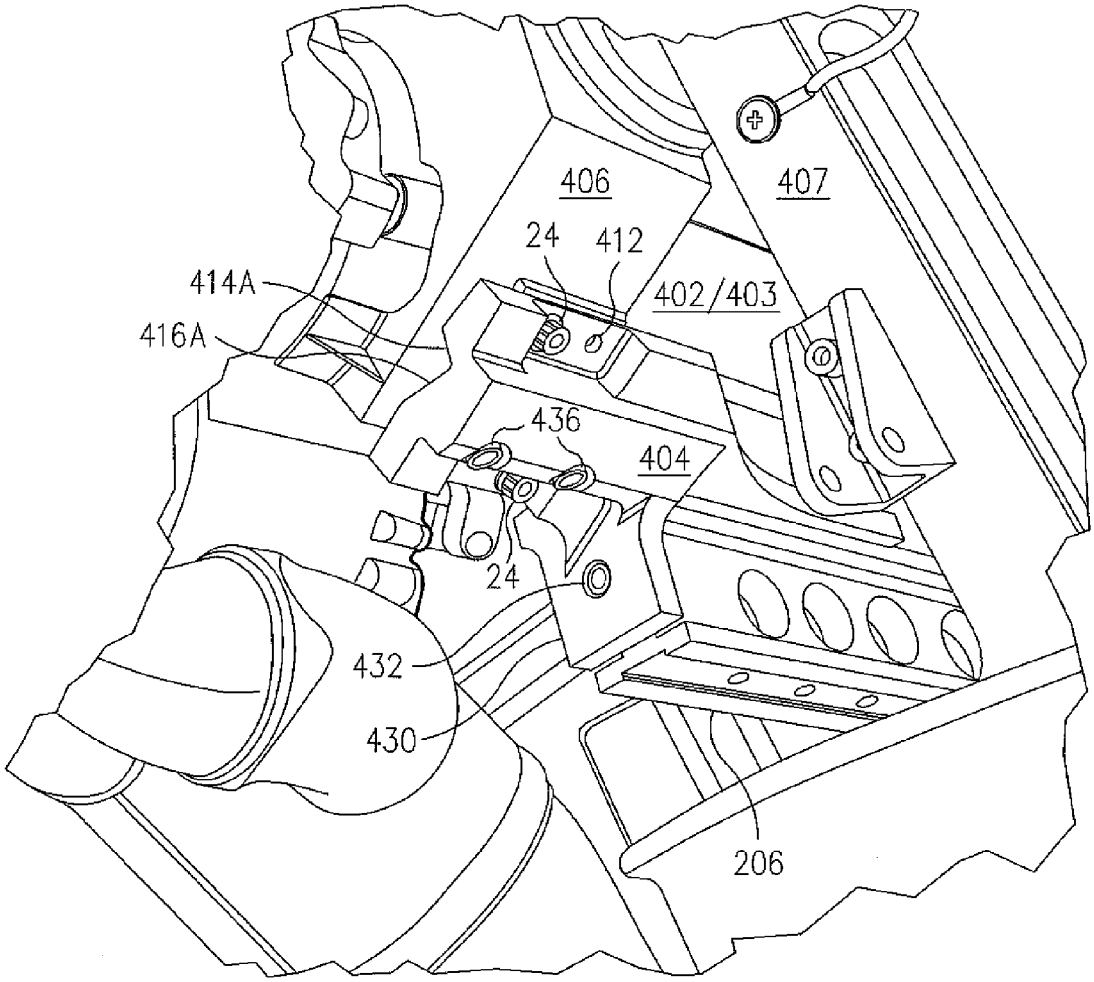
FIG. 46C is a back end and left side perspective view of another version of the accessory mount of FIG. 31 attached to a yoke of an example minigun.
Figure 46D:
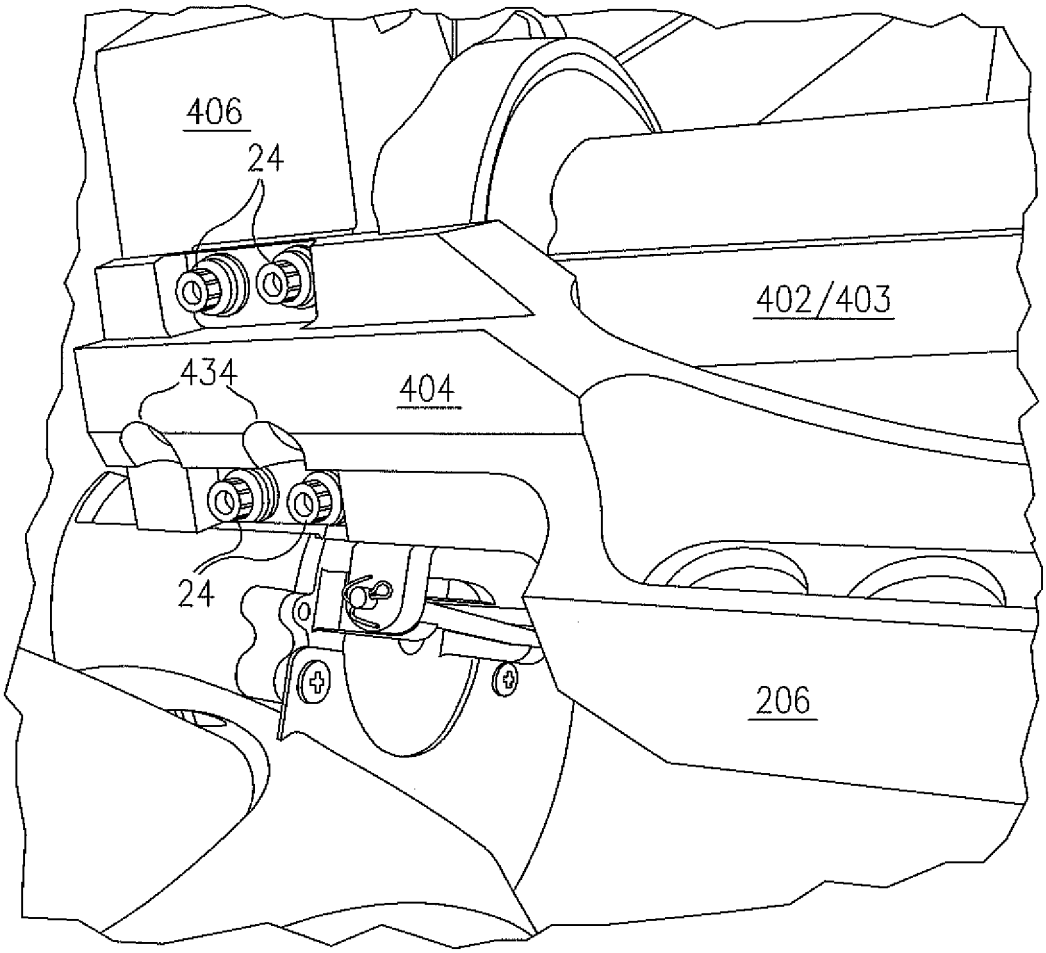
FIG. 46D is a back end and left side perspective view of yet another version of the accessory mount of FIG. 31 attached to a yoke of an example minigun.

As illustrated in FIGS. 46A-D, the accessory mount 400 may attach to a yoke 406 that supports the gun 402 and is connected to a gun mount 407. In this regard, FIG. 46A is a front end and right side perspective view of the accessory mount 400, showing its mounting and alignment relationship to mounting and alignment features 408 of the yoke. FIG. 46B is a front end and left side perspective view of the accessory mount 400 and the gun 402. FIG. 46C is a back end and left side perspective view of another version of the accessory mount 400 attached to the yoke 406 of the gun 402. FIG. 46D is a back end and left side perspective view of yet another version of the accessory mount 400 attached to the yoke 406 of the gun 402.

The yoke 406 defines one or more mounting and alignment features 408 useful for mounting the accessory mount 400 to the gun 402. The mounting and alignment features 408 may include, for example, a raised feature 410 (e.g., a ramp-like structure in one embodiment) extending radially outward from the yoke 406 that includes surfaces 414B and 416B. The mounting and alignment features 408 may also include a plurality of threaded apertures 412 extending into the yoke 406 to receive the threaded bolts 24 to secure the base 404 to the yoke 406.

In one embodiment, the mounting and alignment features 408 shown in FIG. 46A may be provided on a bottom surface of the yoke 406. In this regard, as shown in FIG. 46B, the mounting and alignment features 408 may be positioned under the gun 402 (e.g., on the bottom surface of the yoke 406 which is obscured by the gun 402 in FIG. 46B and is opposite other mounting and alignment features 409). Accordingly, as shown in FIG. 46B, the accessory mount 400 may be moved in the direction denoted by an arrow 438 to attach the base 404 to the mounting and alignment features 408 on the bottom surface of the yoke 406. While so positioned, the accessory mounting arm 206 may be positioned substantially under a barrel 403 of the gun 402 and may extend from the yoke 406 toward the end of the barrel 403 of the gun 402. In another embodiment, the accessory mount 400 may be modified to attach to the other mounting and alignment features 409 (e.g., a mirror image of the mounting and alignment features 408 in one embodiment) to position the accessory mounting arm 206 substantially above the barrel 403 of the gun 402.

As shown in FIG. 46A, the yoke 406 may include accessory mounting apertures 438 in the raised feature 410. Accessory mounting apertures 438 may be threaded, for example, to receive accessory mounting bolts 436 through apertures 434 in the base 404 (see FIGS. 38-43 and 46D) to mount one or more accessories on the base 404 while the accessory mount 400 is installed on the yoke 406, and/or to further secure base 404 to yoke 406.

As illustrated in, e.g., FIGS. 36-39 and 42-45, the base 404 may be implemented as a bracket having mounting and alignment features provided by surfaces 414A and 416A that are complementary in shape to the surfaces 414E and 416B, respectively, of the mounting and alignment features 408 of the yoke 406. In this regard, surfaces 414A and 416A may be configured to engage with surfaces 414B and 416B (e.g., by direct contact and/or with other intermediate structures or substances positioned therebetween) to facilitate the mounting of the accessory mount 400 on the yoke 406 and the alignment of the accessory mount 400 with respect to the yoke 406 and the gun 402.

In one embodiment, the surfaces 414A and 416A may be a pair of substantially planar surfaces disposed on an inwardly facing side of the base 404 that intersect each other at an angle, e.g., a right angle in one embodiment. In one embodiment, the threaded bolts 24 may be extendable through one or more apertures 418 in the base 404 and into corresponding threaded apertures 412 in the yoke 406 to secure the base 404 to the yoke 406. The accessory mount 400 may be used with different yokes, different support structures, and/or different mounting and alignment features in other embodiments.

As illustrated in, e.g., FIGS. 38-40 and 44, the base 404 can include a pair of forwardly extending slots 420 in a side surface of the base 404 that faces away from the gun 402. The slots 420 can be configured to receive a side surface of a rear end portion of the accessory mounting arm 206 in a complementary engagement, and as illustrated in FIG. 35, the accessory mounting arm 206 can be coupled to the base 404 by one or more threaded fasteners 220 that extend through one or more corresponding apertures 422 (see, e.g., FIGS. 38-41) in the base 404 and into one or more corresponding threaded apertures in the accessory mounting arm 206.

Figure 35:
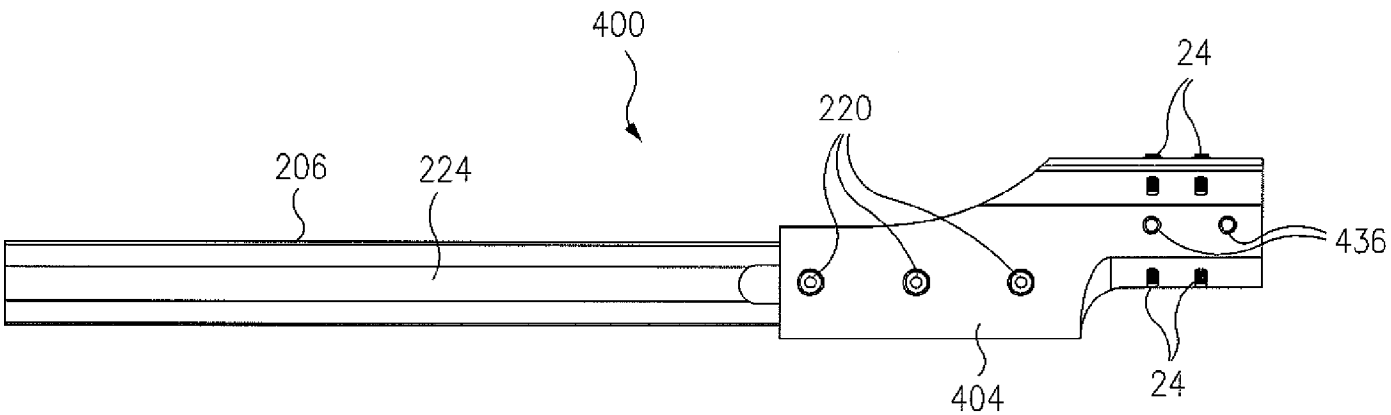
FIG. 35 is a bottom plan view of the accessory mount of FIG. 31.
Figure 36:
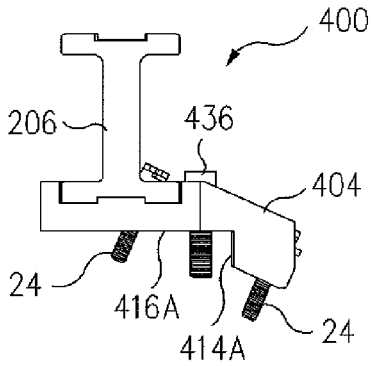
FIG. 36 is a front end elevation view of the accessory mount of FIG. 31.
Figure 37:
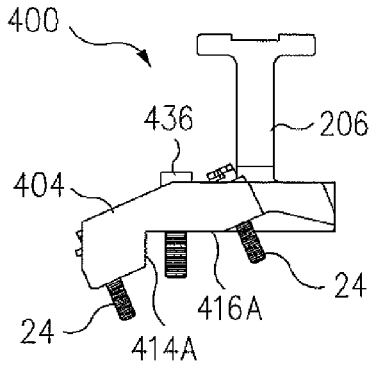
FIG. 37 is a rear end elevation view of the accessory mount of FIG. 31.
Figure 38:
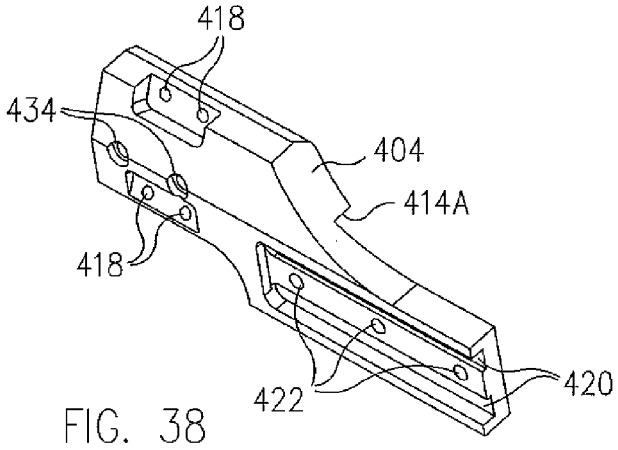
FIG. 38 is a front end and outer side perspective view of an example embodiment of a base of the accessory mount of FIG. 31.
Figure 39:
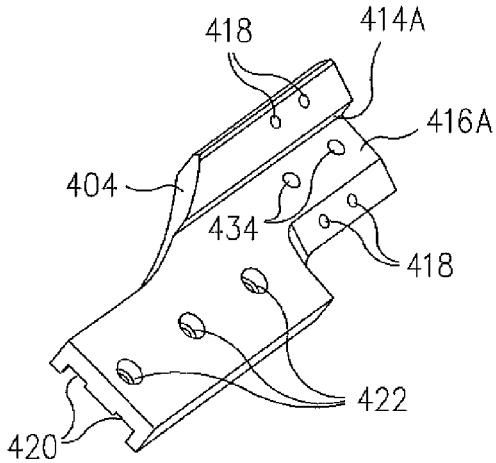
FIG. 39 is a front end and inner side perspective view of the base of FIG. 38.
Figure 40:
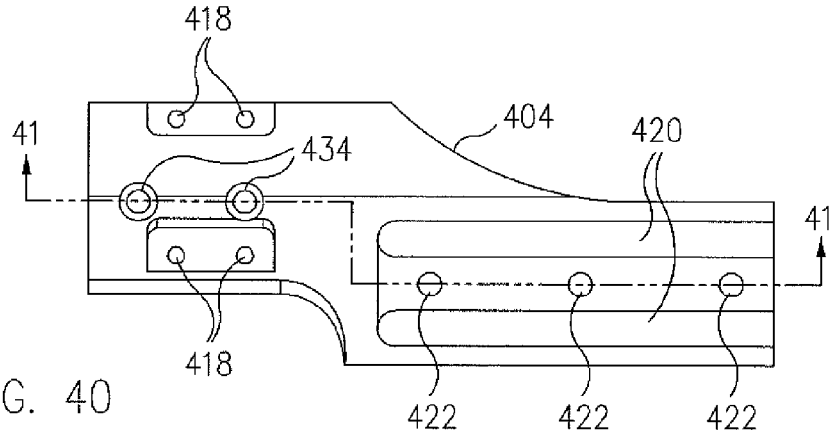
FIG. 40 is plan view of the outer side of the base of FIG. 38.
Figure 41:
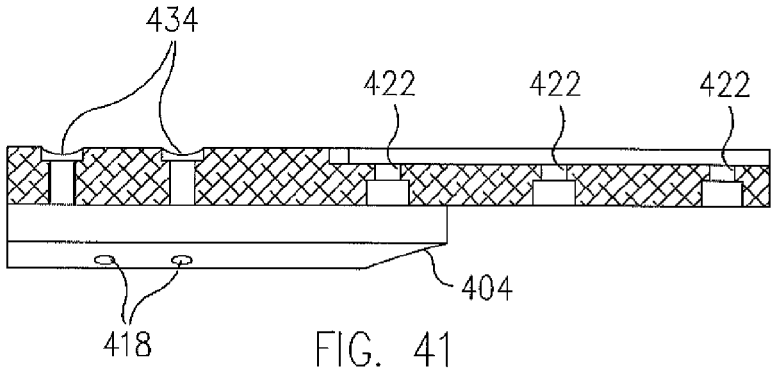
FIG. 41 is a cross-sectional view of the base of FIG. 40, as seen along the lines of the section 41-41 taken therein.
Figure 42:
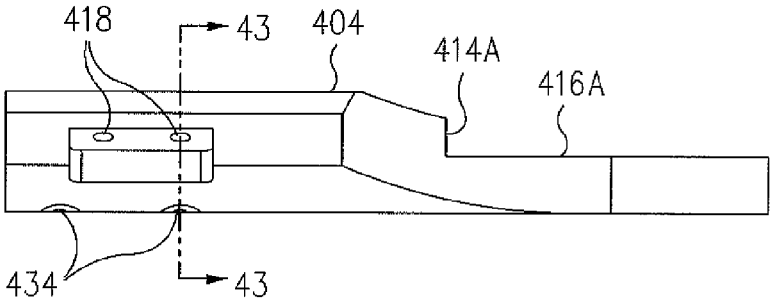
FIG. 42 is a plan view of another side of the base of FIG. 38.
Figure 43:
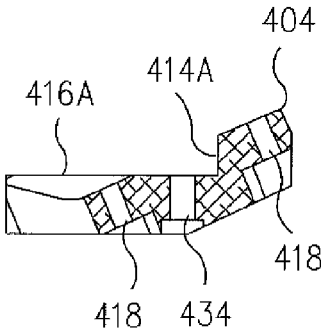
FIG. 43 is a cross-sectional view of the base of FIG. 42, as seen along the lines of the section 43-43 taken therein.
Figure 44:
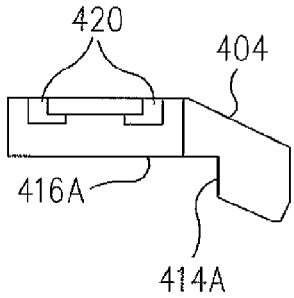
FIG. 44 is a front end elevation view of the base of FIG. 38.
Figure 45:
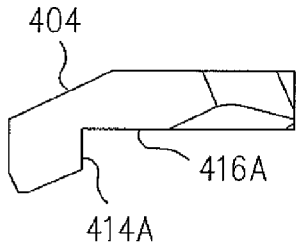
FIG. 45 is a rear end elevation view of the base of FIG. 38.

In one embodiment, such as illustrated in FIG. 35, the base 404 and the accessory mounting arm 206 may be components that are coupled together by, for example, one or more threaded fasteners 220 as discussed.

In another embodiment, such as illustrated in FIG. 46C, the base 404 may include a rear support extension 430 with an aperture configured to receive another threaded fastener 432 (e.g., implemented by a threaded bolt or other appropriate structure) that extends into a corresponding threaded aperture in accessory mounting arm 206 to further secure base 404 to the accessory mounting arm 206.

In another embodiment, such as illustrated in FIG. 46D, the base 404 and the accessory mounting arm 206 may be implemented as a single component (e.g., machined, formed, or otherwise provided as a single piece) that may be installed on the yoke 406 by the threaded bolts 24.

In various embodiments, one or more accessory mounting rails 34, 36, e.g., a Picatinny rail 34, can be used with the accessory mount 400 to secure one or more accessories to the gun 402 in a similar fashion as illustrated and described with regard to the accessory mounts 10 and 200.

Figure 47:
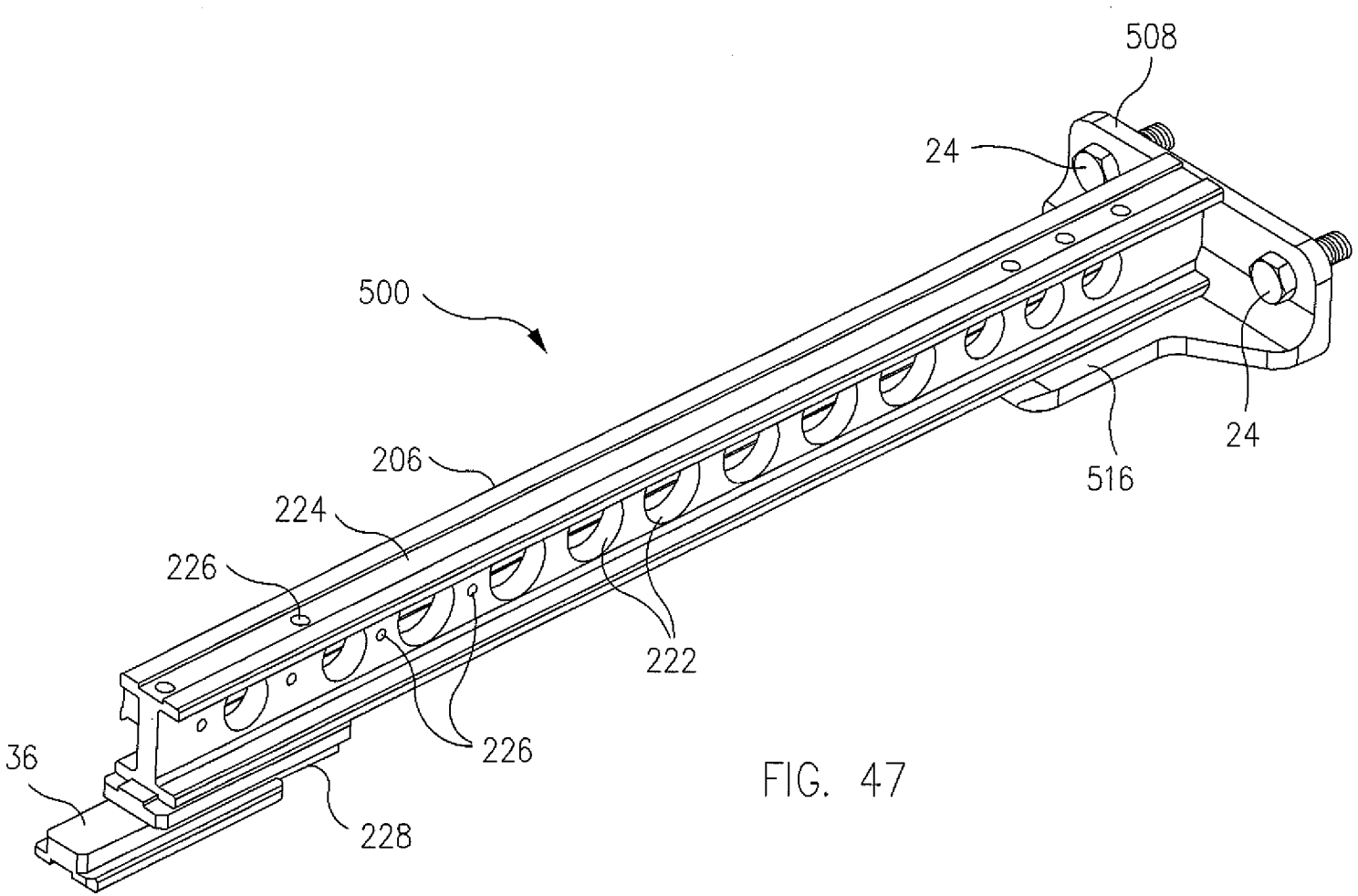
FIG. 47 is a front end and left side perspective view of an example embodiment of another machine gun accessory mount.
Figure 48:
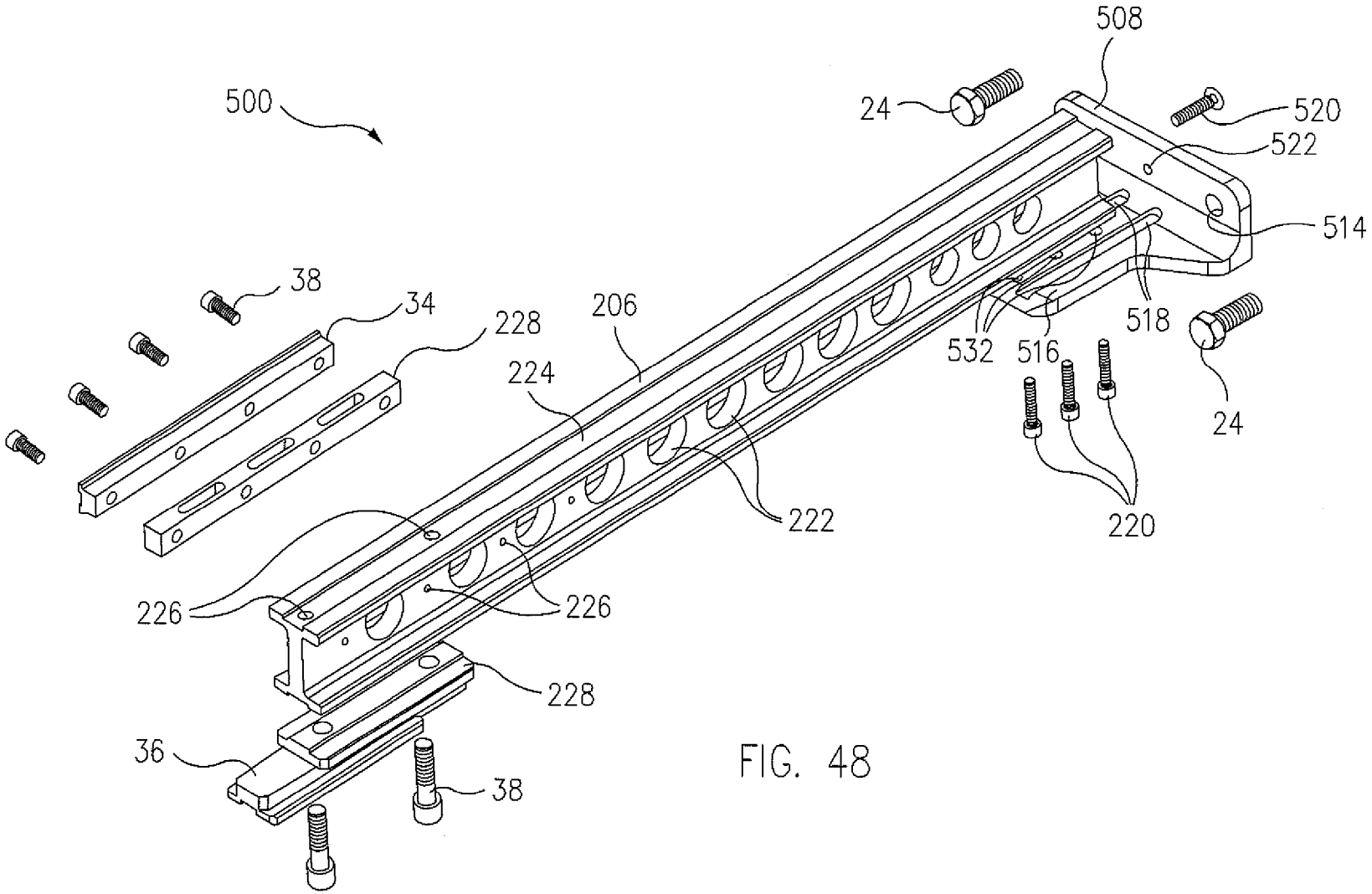
FIG. 48 is an exploded perspective view of the accessory mount of FIG. 47.
Figure 49:
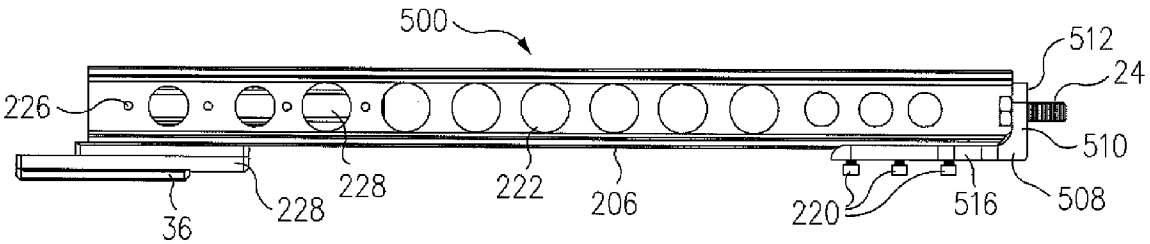
FIG. 49 is a left side elevation view of the accessory mount of FIG. 47.
Figure 50:
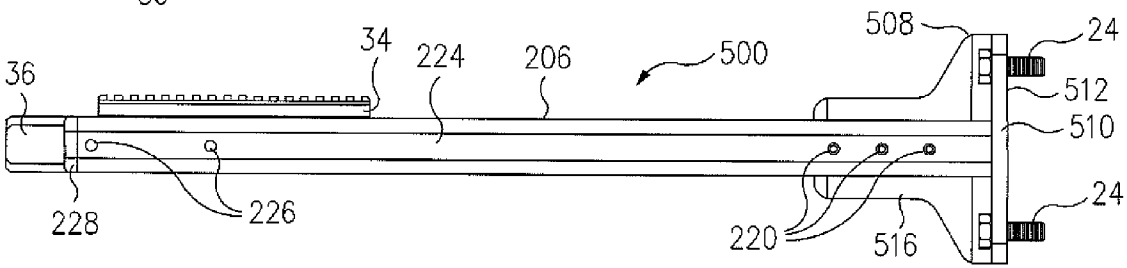
FIG. 50 is a top plan view of the accessory mount of FIG. 47.
Figure 51:
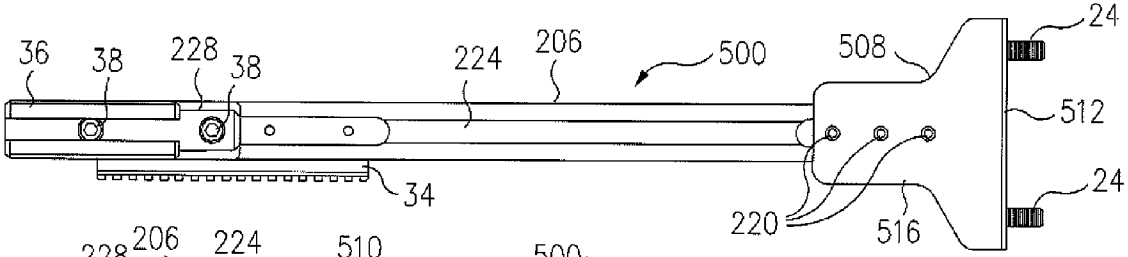
FIG. 51 is a bottom plan view of the accessory mount of FIG. 47.
Figure 52:
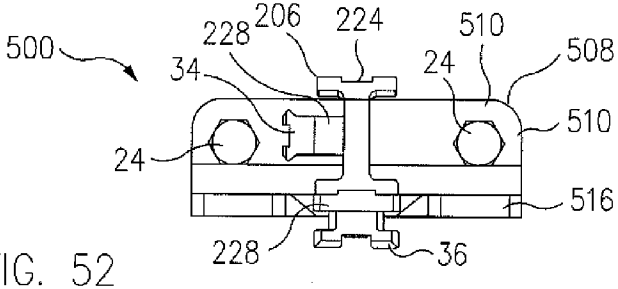
FIG. 52 is a front end elevation view of the accessory mount of FIG. 47.
Figure 53:
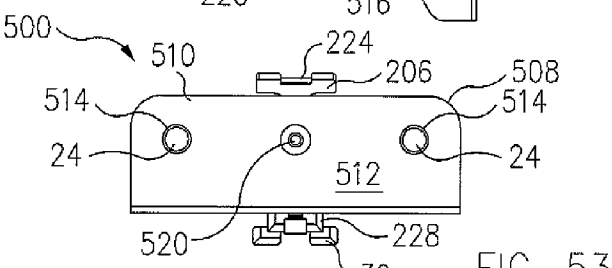
FIG. 53 is a rear end elevation view of the accessory mount of FIG. 47.

Another example embodiment of a machine gun accessory mount 500 is illustrated in the front end and left side perspective view and exploded perspective view of FIGS. 47 and 48, respectively. FIGS. 49-51 are left side elevation, top plan, and bottom plan views of the accessory mount 500, respectively, and FIGS. 52 and 53 are front end elevation and rear end elevation views of the accessory mount 500, respectively.

Figure 54:
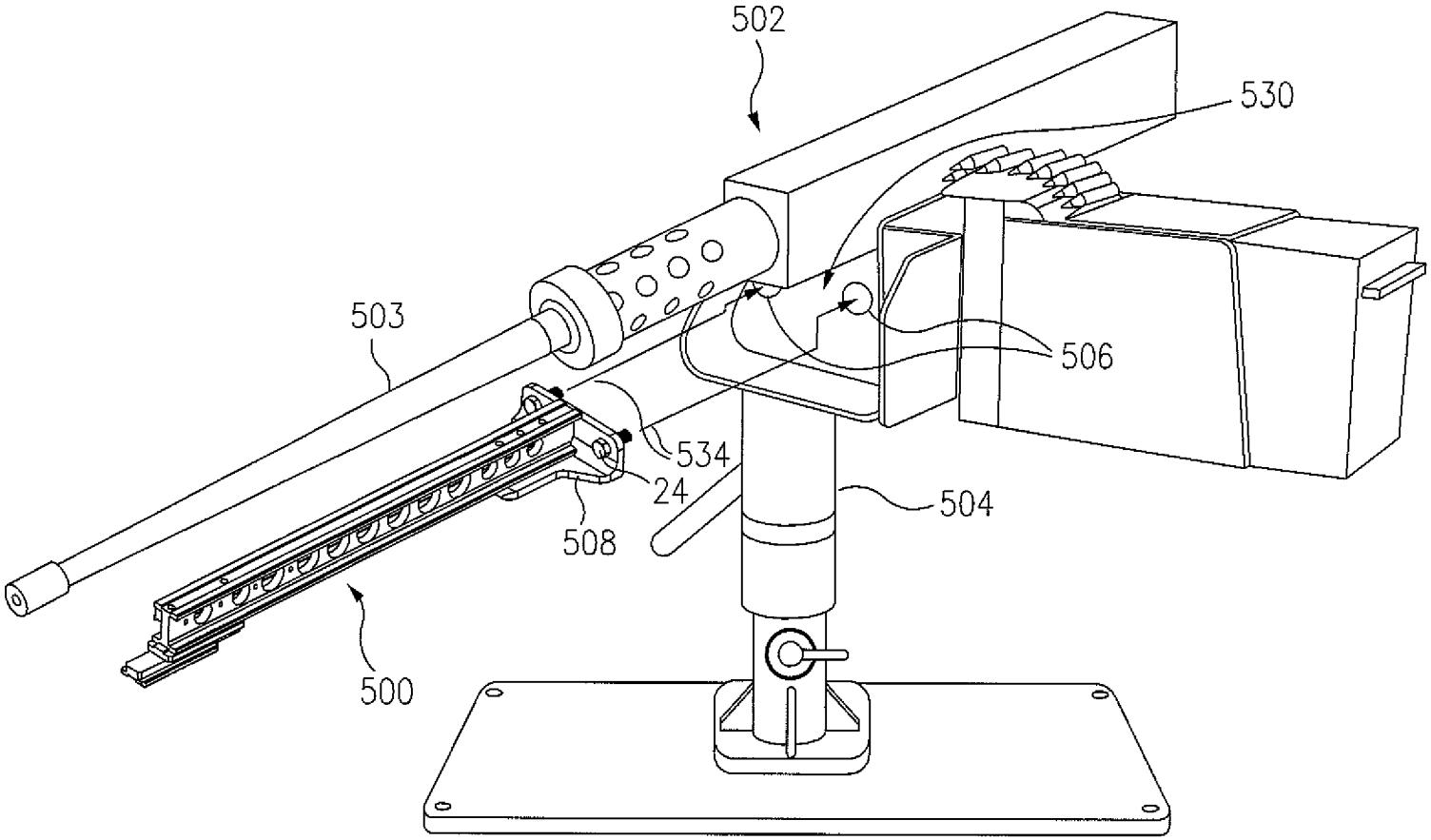
FIG. 54 is a front end and left side perspective view of the accessory mount of FIG. 47, showing its mounting and alignment relationship to a gun mount of a machine gun.

As illustrated in FIG. 54, in one embodiment, the accessory mount 500 is advantageously configured to operate in conjunction with a machine gun 502 (e.g., a Browning .50 caliber M2HB heavy machine gun in one embodiment) that includes (e.g., is mounted on) a gun mount 504 (e.g., an M93 gun mount in one embodiment) that includes a front surface 530 below the gun 502, a portion of which is substantially flat, and which includes at least one threaded mounting aperture 506 disposed therein. The accessory mount 500 may be used with other guns and/or mounts in other embodiments.

As illustrated in, e.g., FIGS. 47-48, and as in the embodiments described above in conjunction with, e.g., FIGS. 21 and 31, the accessory mount 500 can comprise a base 508 configured for attachment of the accessory mount 500 to the gun 502, and in particular to the gun mount 504, a holding mechanism (e.g., threaded bolts 24, threaded fasteners, or any other appropriate structures) for fixing the position of the base 508 in relation to the gun 502, and an elongated accessory mounting arm 206 coupled to the base 508 and extending forwardly therefrom. And as in the embodiments of FIGS. 21 and 31 discussed above, in some embodiments, the accessory mounting arm 206 can comprise a beam having a vertical web 208 with at least one flange 210 disposed at an upper and/or a lower end thereof, i.e., a T-beam or an I-beam. In some embodiments, the accessory mounting arm 206 of the accessory mount 400 may be implemented in the same or similar manner as illustrated and described for the accessory mount 200.

As illustrated in FIGS. 49-53, in some embodiments, the base 508 of the accessory mount 500 can comprise an L-shaped bracket having an upstanding leg 510 with a substantially flat rear surface 512 and at least one through-hole 514 corresponding to the at least one threaded mounting aperture 506 in the gun mount 504, and as illustrated in, e.g., FIG. 54, the holding mechanism can comprise at least one threaded bolt 24 that is extendable through the at least one corresponding aperture 514 in the bracket 509 and into the at least one threaded mounting aperture 506 in the gun mount 504 as denoted by arrows 534. Accordingly, as shown in FIG. 54, the accessory mount 500 may be moved in the directions denoted by arrows 534 to attach the base 508 to the gun mount 504 by inserting the threaded bolts 24 through the through-holes 514 of the base 508 and into the threaded mounting apertures 506 on the front surface 530 of the gun mount 504. While so positioned, the accessory mounting arm 206 may be positioned substantially under a barrel 503 of the gun 502 and may extend from the gun mount 504 toward the end of the barrel 503 of the gun 502.

As illustrated in, e.g., FIG. 48, in some embodiments, the base 508 can also include a leg 516 that extends forwardly from the upstanding leg 510. In some embodiments, the forwardly extending leg 516 can have an upper surface with a pair of forwardly extending slots 518 disposed therein, and the slots 518 can be configured to receive a bottom surface of a rear end portion of the accessory mounting arm 206 in a complementary engagement. In some embodiments, the accessory mounting arm 206 can be coupled to the base 508 by at least one threaded fastener 220 that extends through at least one corresponding aperture 532 in the base 508 and into a corresponding threaded aperture in the accessory mounting arm 206. As illustrated in, e.g., FIGS. 48 and 53, in some embodiments, the accessory mounting arm 206 can also be coupled to the base 508 by at least one flat-headed bolt 520 that extends forwardly through a countersunk aperture 522 in the rear surface 512 of the leg 510 of the base 508 and into a corresponding threaded aperture in the accessory mounting arm 206.

In various embodiments, one or more accessory mounting rails 34, 36, e.g., a Picatinny rail 34, can be used with the accessory mount 500 to secure one or more accessories to the gun 502 in a similar fashion as illustrated and described with regard to the accessory mounts 10, 200, and 300, and as illustrated in FIGS. 47-54.

By now, those of skill in this art will appreciate that many modifications, substitutions and variations can be made in and to the materials, apparatus, configurations and methods of the machine gun accessory mounts of the present disclosure without departing from its spirit and scope. Accordingly, the scope of the present disclosure should not be limited to the particular embodiments illustrated and described herein, as they are merely by way of some examples thereof, but rather, should be fully commensurate with that of the claims appended hereafter and their functional equivalents. Moreover, any aspects of the various embodiments provided by the present disclosure can be combined with each other where appropriate.

What is claimed is:

1. An accessory mount for a gun, the mount comprising:

a base configured to attach the accessory mount to the gun, wherein the base comprises an annular structure having a circular central opening configured to be disposed concentrically over a barrel of the gun and a concentric counterbore extending into a rear surface thereof, wherein the counterbore defines a substantially planar floor and is configured to be disposed concentrically over a front end of a shroud of the gun, with the floor of the counterbore disposed against a substantially planar front surface of the shroud;

a holding mechanism configured to fix the position of the base in relation to the gun, wherein the holding mechanism comprises:

a plurality of threaded bolts extending rearwardly from the base through respective bolt apertures contained therein, a plurality of cleats, each having an opening through which a rear end portion of a respective one of the bolts extends and a hook adapted to grip an edge of a corresponding hole in the shroud of the gun, and wherein the cleats are arranged such that advancement of the bolts into respective ones of the cleats causes the hook of each cleat to grip the edge of the corresponding hole in the shroud of the gun and the planar floor of the counterbore in the rear surface of the base to be pulled into contact with and held against the planar front surface of the shroud; and an elongated accessory mounting arm coupled to the base and extending forwardly therefrom, the arm comprising a beam having a vertical web with at least one flange disposed at an upper and/or a lower end thereof.

2. The accessory mount of claim 1, wherein:

the base includes a tailpiece extending rearwardly therefrom; and the accessory mounting arm is coupled to both the base and the tailpiece.

3. The accessory mount of claim 2, wherein the accessory mounting arm is coupled to the base and the tailpiece by a welded joint, a brazed joint, an adhesive joint, or at least one fastener.

4. The accessory mount of claim 3, wherein the at least one fastener comprises a rivet, a dowel pin, a roll pin, a coiled spring pin, or a threaded fastener.

5. The accessory mount of claim 1, wherein the web of the accessory mounting arm includes at least one lightening hole extending therethrough.

6. The accessory mount of claim 1, wherein the accessory mounting arm comprises an extrusion.

7. The accessory mount of claim 1, wherein at least one of the base and the accessory mounting arm comprises an anodized aluminum outer surface.

8. The accessory mount of claim 1, wherein the gun comprises a machine gun.

9. A method of mounting an accessory on a gun, the method comprising:

providing an accessory mount in accordance with claim 1;

mounting the accessory mount on the gun; and mounting the accessory on the accessory mount.

10. An accessory mount for a gun, the mount comprising:

a base configured to attach the accessory mount to the gun, wherein the gun includes a yoke defining a first mounting and alignment feature, wherein the base comprises a bracket having a second mounting and alignment feature that is complementary in shape to the first mounting and alignment feature;

a holding mechanism configured to fix the position of the base in relation to the gun, wherein the holding mechanism comprises at least one threaded fastener extendable through an aperture in the bracket and into a corresponding threaded aperture in the yoke while the first and second mounting and alignment features are engaged with each other;

an elongated accessory mounting arm coupled to the base and extending forwardly therefrom, the arm comprising a beam having a vertical web with at least one flange disposed at an upper and/or a lower end thereof;

wherein the bracket includes a pair of forwardly extending slots in a side surface of the bracket facing away from the gun, the slots being configured to receive a side surface of a rear end portion of the accessory mounting arm in a complementary engagement; and at least one threaded fastener extending through at least one through aperture in the accessory mounting arm and into a corresponding threaded aperture in the bracket.

11. The accessory mount of claim 10, wherein:

the first mounting and alignment feature comprises a raised feature extending radially outward from the yoke; and the second mounting and alignment feature comprises first and second substantially planar surfaces disposed on a side of the bracket configured to face the raised feature of the yoke.

12. The accessory mount of claim 10, wherein the gun comprises a machine gun.

13. A method of mounting an accessory on a gun, the method comprising:

providing an accessory mount in accordance with claim 10;

mounting the accessory mount on the yoke; and mounting the accessory on the accessory mount.

14. An accessory mount for a gun, the mount comprising:

a base configured to attach the accessory mount to the gun, wherein the gun includes a gun mount having a front surface, a portion of which is substantially flat and which includes at least one threaded mounting aperture disposed therein, wherein the base comprises an L-shaped bracket having an upstanding leg with a substantially flat rear surface and at least one through-hole corresponding to the at least one threaded mounting aperture in the gun mount;

a holding mechanism configured to fix the position of the base in relation to the gun, wherein the holding mechanism comprises at least one threaded fastener extendable through the at least one corresponding aperture in the bracket and into the at least one threaded mounting aperture in the gun mount;

an elongated accessory mounting arm coupled to the base and extending forwardly therefrom, the arm comprising a beam having a vertical web with at least one flange disposed at an upper and/or a lower end thereof;

wherein the bracket includes a leg extending forwardly from the upstanding leg, the forwardly extending leg having an upper surface with a pair of forwardly extending slots disposed therein, the slots being configured to receive a bottom surface of a rear end portion of the accessory mounting arm in a complementary engagement; and at least one threaded fastener extending through an aperture in the accessory mounting arm and into a corresponding threaded aperture in the bracket.

15. The accessory mount of claim 14, wherein the gun is a machine gun.

16. A method of mounting an accessory on a gun, the method comprising:

providing an accessory mount in accordance with claim 14;

mounting the accessory mount on the gun mount; and mounting the accessory on the accessory mount.

* * * * *